US011644782B2

(12) United States Patent
Uchida

(10) Patent No.: US 11,644,782 B2
(45) Date of Patent: May 9, 2023

(54) IMAGE FORMING APPARATUS

(71) Applicant: KONICA MINOLTA, INC., Tokyo (JP)

(72) Inventor: Yuji Uchida, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/872,764

(22) Filed: Jul. 25, 2022

(65) Prior Publication Data

US 2023/0080058 A1 Mar. 16, 2023

(30) Foreign Application Priority Data

Sep. 13, 2021 (JP) ..... JP2021-148788

(51) Int. Cl.
*G03G 15/00* (2006.01)
*G03G 15/01* (2006.01)

(52) U.S. Cl.
CPC ..... *G03G 15/5041* (2013.01); *G03G 15/0105* (2013.01); *G03G 15/5054* (2013.01); *G03G 15/5058* (2013.01); *G03G 15/5062* (2013.01); *G03G 2215/0187* (2013.01); *G03G 2215/2074* (2013.01)

(58) Field of Classification Search
CPC ..... G03G 15/0105; G03G 15/5041; G03G 15/5054; G03G 15/5058; G03G 15/5062; G03G 2215/0187; G03G 2215/2074
See application file for complete search history.

(56) References Cited

U.S. PATENT DOCUMENTS

2011/0211853 A1* 9/2011 Yamada ..... G03G 15/0194 399/49
2011/0317182 A1* 12/2011 Murayama ..... G03G 15/5058 358/1.9
2018/0159989 A1* 6/2018 Mizuno ..... G03G 15/234

FOREIGN PATENT DOCUMENTS

JP 2003182146 A 7/2003

* cited by examiner

*Primary Examiner* — Joseph S Wong
(74) *Attorney, Agent, or Firm* — Holtz, Holtz & Volek PC

(57) ABSTRACT

To provide an image forming apparatus capable of achieving both correction accuracy of skew correction and minimization of a margin between images. A color shift amount calculator that calculates a color shift amount, and a first skew correction controller and a second skew correction controller that control skew correction of color shift are included. The first skew correction controller controls first skew correction by a mechanical operation by the image former on the basis of a first color shift residual target value set in advance. The second skew correction controller controls second skew correction, by image processing, of the color shift after the control by the first skew correction controller on the basis of a second color shift residual target value set in advance.

13 Claims, 16 Drawing Sheets

IMAGE FORMING APPARATUS

CROSS-REFERENCE TO RELATED APPLICATIONS

The entire disclosure of Japanese patent Application No. 2021-148788, filed on 2021, September 13, is incorporated herein by reference in its entirety.

BACKGROUND

Technological Field

The present invention relates to an image forming apparatus.

Description of the Related Art

An image forming apparatus forms a color image by superimposing images of a plurality of colors. When a color image is formed using, for example, toners of four colors, four electrostatic latent images are formed by scanning a photoreceptor with light beams modulated according to an image to be formed. Then, the electrostatic latent images are developed with toners of different colors including, for example, black (K), cyan (C), magenta (M), and yellow (Y), whereby four monochrome images are formed. Furthermore, these four monochrome images are superimposed on each other and transferred to a recording material. Thus, the color image is formed.

Here, if there is a shift between the image forming positions of the monochrome images, it is visually recognized as color shift on the color image.

In order to form a high-quality color image with no color shift, it is necessary to detect shift amounts between a monochrome image as a reference and other monochrome images, and to accurately adjust the image forming position of each monochrome image according to the detected shift amount. In an image forming apparatus, such adjustment is called color shift correction.

In the color shift correction in an image forming apparatus, six components of main scanning, entire lateral magnification, partial lateral magnification, sub-scanning, skew, and bow are generally corrected. In these corrections, a configuration to be realized is different for each model of an image forming apparatus. For example, a controller of an image forming apparatus has a function of correcting, by image processing, color shifts of main scanning, entire lateral magnification, partial lateral magnification, sub-scanning, and bow.

To the color shift correction of skew (skew correction), two methods, including a configuration in which correction is performed by a mechanical mechanism of an image forming apparatus and a configuration in which correction is performed by image processing by the controller, can be applied.

In the skew correction by the mechanical mechanism, laser scanning is obliquely performed on a photoreceptor drum by, for example, driving a motor to tilt a laser unit. In addition, in the skew correction by the image processing, image data is tilted by the image processing by the controller. As a result, the skew correction is performed in the image forming apparatus.

In image forming apparatuses, there is also proposed an image forming apparatus having a configuration of so-called hybrid correction in which skew correction is performed by two configurations including correction by a mechanical mechanism and correction by image processing (see, for example, Patent Literature 1).

When it is determined that a color shift amount of skew exceeds an allowable range of the correction by the image processing, the image forming apparatus performs the correction by the mechanical mechanism to correct the color shift amount to a value that falls within the allowable range of the correction by the image processing. Thereafter, the image forming apparatus executes the correction by the image processing on the color shift reduced by the mechanical mechanism.

When it is determined that the color shift amount of skew is within the allowable range of the correction by the image processing, the image forming apparatus only performs the correction by the image processing.

RELATED ART LITERATURE

Patent Literature

Patent Literature 1: JP 2003-182146 A

SUMMARY

Since the skew correction by the image processing has a correction resolution in units of μm, correction with high accuracy can be performed. Therefore, an image forming apparatus that performs the above hybrid correction maximizes the correction by the skew correction by the image processing, whereby skew correction with high accuracy is performed.

In the skew correction by the image processing, however, it is necessary to tilt image data by the image processing. In this case, it is necessary to extend an image size in a conveyance direction (length direction) of a recording material in order to avoid image loss. In addition, the image data cannot be superimposed between pages, so that an extended image size appears as a margin (image interval) between the pages.

In an image forming apparatus having a configuration to continually form images on a recording material such as roll paper, a margin between pages is discarded (waste paper). Therefore, it is required to reduce a margin amount in the image formation.

In addition, in the correction by the mechanical mechanism, a margin is not created between the pages, but the positions are adjusted by a mechanical mechanism using a motor, so that it is difficult to accurately obtain a correction resolution in units of μm and to perform correction with high accuracy.

Therefore, in an image forming apparatus that forms a color image by superimposing monochrome images, it is required to ensure correction accuracy in skew correction and minimize a margin between the images.

In order to solve the above problem, the present invention provides an image forming apparatus capable of achieving both correction accuracy in skew correction and minimization of a margin between images.

An image forming apparatus of the present invention is an image forming apparatus that forms an image of a plurality of colors on a recording material. The image forming apparatus includes an image former that forms an image on the recording material, and a controller that controls the image formation by the image former and skew correction in the image formation. The controller includes a color shift amount calculator that calculates a color shift amount from color shift of an image of each color in the image former, and a first skew correction controller and a second skew correction controller that control the skew correction of the color shift. The first skew correction controller controls first skew correction by a mechanical operation by the image former on the basis of a first color shift residual target value set in advance. The second skew correction controller controls second skew correction, by image processing, of the color shift after the control by the first skew correction controller on the basis of a second color shift residual target value set in advance.

According to an embodiment of the present invention, it is possible to provide an image forming apparatus capable of achieving both correction accuracy of skew correction and minimization of a margin between images.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

<Embodiments of Image Forming Apparatus>

Hereinafter, one or more embodiments of the present invention will be described with reference to the drawings. However, the scope of the invention is not limited to the disclosed embodiments.

Hereinafter, an example of an embodiment of an image forming apparatus of the present invention will be described, but the present invention is not limited to the following example.

[Configuration of Image Forming Apparatus]

Figure 1:
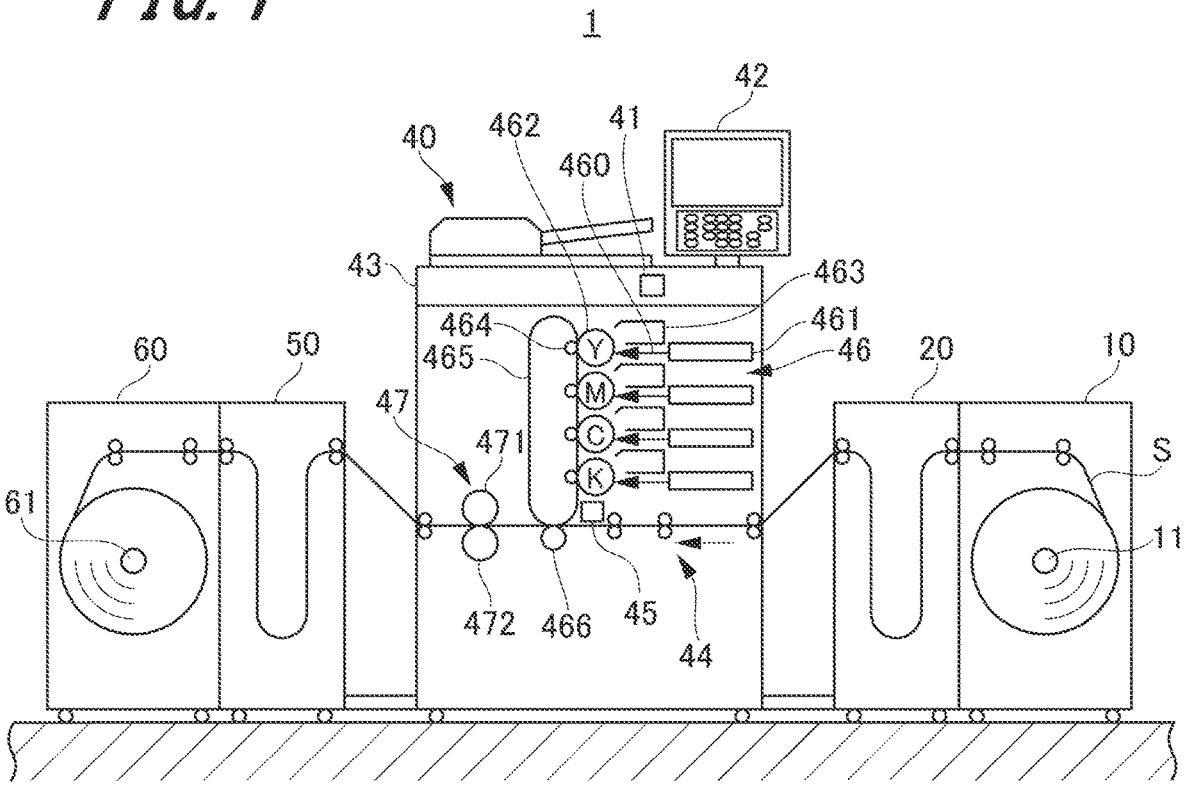
FIG. 1 is a diagram illustrating a schematic configuration of an image forming system.

FIG. 1 illustrates a schematic configuration of an image forming system including an image forming apparatus of the present embodiment. An image forming system 1 illustrated in FIG. 1 uses a roll-shaped recording material S that is continuous paper as a recording material, and forms an image on the recording material S. The image forming system 1 includes, from an upstream side in a conveyance direction of the recording material S, a paper feeder 10, an image forming apparatus 40, and a recovery apparatus 60. The image forming system 1 illustrated in FIG. 1 includes a supply adjuster 20 between the paper feeder 10 and the image forming apparatus 40, and a recovery adjuster 50 between the image forming apparatus 40 and the recovery apparatus 60.

The paper feeder 10 includes a support shaft 11 that rotatably holds the recording material S wound in a roll shape, and conveys the recording material S wound around the support shaft 11 to the supply adjuster 20 at a constant speed by a plurality of rollers. Note that the shape of the recording material S is not limited to the roll-shaped continuous paper. The recording material S only needs to have a length that enables continual image formation of a plurality of pages on the recording material S in the image forming apparatus 40. For example, a foldable shape or a long paper shape can be applied as the shape of the recording material S. The paper feeder 10 is an example of a recording material supply apparatus that supplies a recording material to the image forming apparatus 40.

The supply adjuster 20 conveys the recording material S conveyed from the paper feeder 10 to an image former 46 of the image forming apparatus 40. In order to absorb a speed difference between the paper feeding and conveyance speed of the recording material S from the paper feeder 10 and the conveyance speed of the recording material S in the image former 46, the supply adjuster 20 holds the recording material S in a slack state, and adjusts the feeding of the recording material S to the image former 46.

The image forming apparatus 40 includes a controller 41, an operation display 42, a scanner 43, a conveyor 44, a color shift detection sensor 45, the image former 46, a fixing unit 47, and the like. Note that the image forming apparatus 40 may include the above paper feeder 10 as a recording material feeder in a device of the image forming apparatus 40.

The scanner 43 exposes and scans a manuscript surface placed on a manuscript table with a light source to receive reflected light from the manuscript surface, photoelectrically converts the received reflected light with a charge coupled device (CCD) to generate image data, and outputs the image data to the controller 41.

The controller 41 integrally controls each configuration of the image forming system 1 and the image forming apparatus 40. In addition, the controller 41 performs image processing on the image data input from the scanner 43 or the controller 41, and outputs the image data to the image former 46. Furthermore, the controller 41 detects positional shift (color shift) of a toner image of each color from a position of the toner image of each color detected by the color shift detection sensor 45, and calculates a color shift amount of the toner image of each color. Details of the configuration of the controller 41 will be described later.

The operation display 42 includes a display including a display such as a liquid crystal display, and an operation unit including a touch panel, a plurality of keys, and the like that are provided to overlap the display. A display screen of the display is covered with a pressure-sensitive (resistance film pressure type) touch panel in which transparent electrodes are arranged in a grid pattern, where an XY coordinate of a point of force pressed down with a finger, a touch pen, or the like is detected as a voltage value, and the detected position signal is output to the controller 41 as an operation signal. In addition, the operation display 42 includes various operation buttons such as numeric buttons and a start button, and outputs an operation signal by button operation to the controller 41.

The image former 46 forms an image on the recording material S conveyed from the supply adjuster 20 by an electrophotographic method on the basis of the image data of each page input from the controller 41. The image former 46 is provided with a recording material conveyance path in which a conveyance belt, a conveyance roller such as a resist roller, and a non-illustrated motor that drives them are arranged. According to the control from the controller 41, the image former 46 forms an image on the recording material S that is being conveyed.

The image former 46 includes four sets of exposure units 461, photoreceptors 462, developing units 463, and primary transfer rollers 464, they corresponding to respective color components of Y, M, C, and K, an intermediate transfer belt 465, and a secondary transfer roller 466. The four sets of the exposure units 461, the photoreceptors 462, the developing units 463, and the primary transfer rollers 464, they corresponding to the respective color components, are lined up in the order of Y, M, C, and K from the upstream.

The exposure unit 461 includes a laser writing unit, a tilt adjuster for the laser writing unit, a polygon motor, a polygon mirror, a plurality of lenses, and the like. The exposure unit 461 irradiates and exposes the charged photoreceptor 462 with and to a laser beam 460 by the laser writing unit and the polygon mirror according to a recording material conveyance speed, and forms an electrostatic latent image on the photoreceptor 462.

Figure 2:
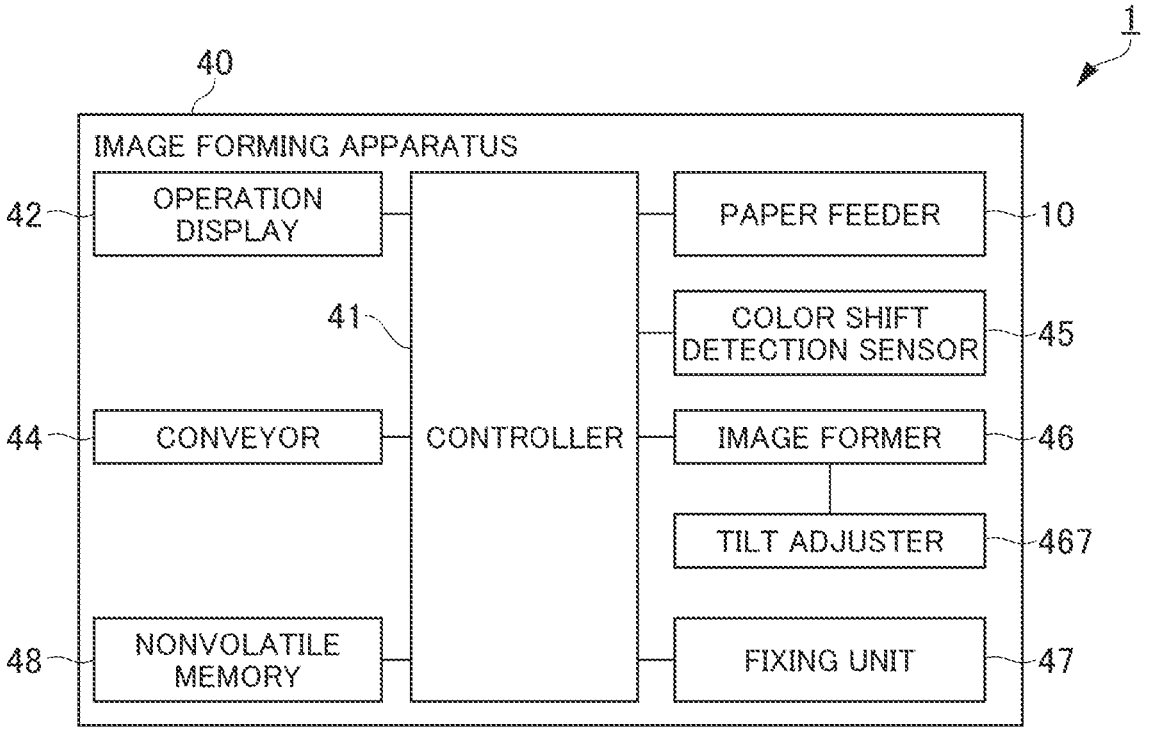
FIG. 2 is a block diagram illustrating a configuration of an image forming apparatus.
Figure 4:
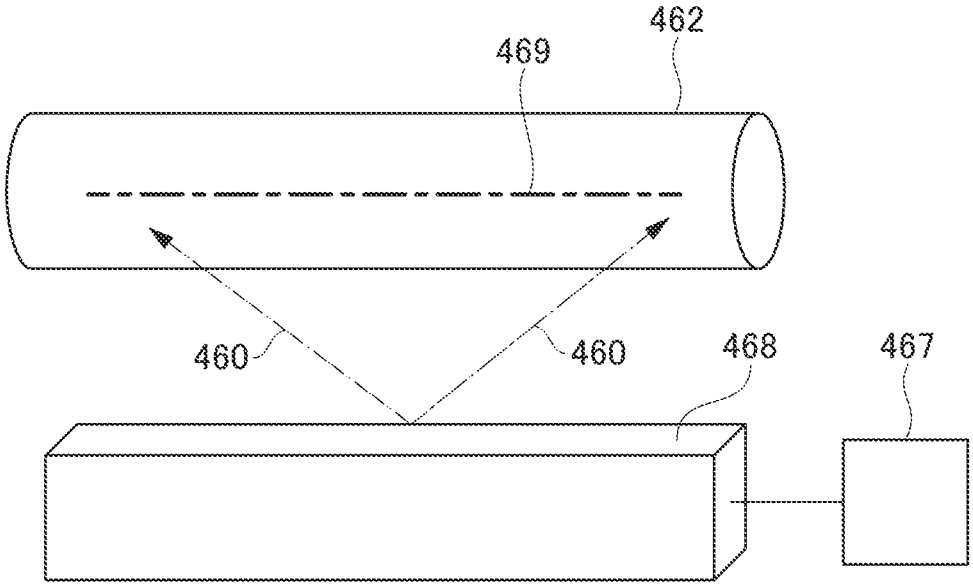
FIG. 4 is a diagram for explaining control of first skew correction by a mechanical mechanism by a first skew correction controller.
Figure 5:
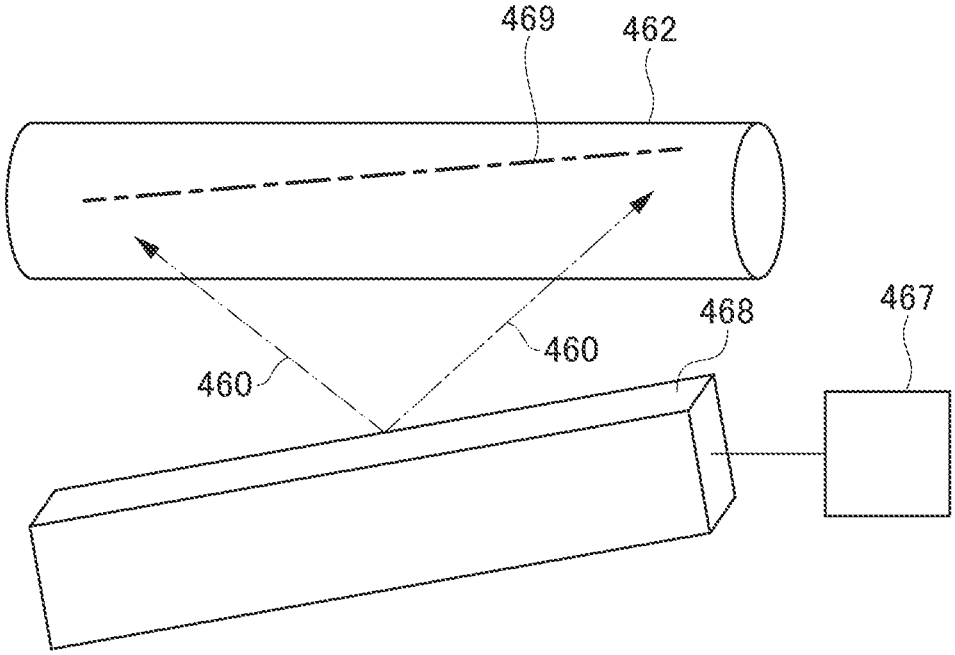
FIG. 5 is a diagram for explaining the control of the first skew correction by the mechanical mechanism by the first skew correction controller.

In the exposure unit 461, the angle (tilt) of a trajectory (laser trajectory) in the laser writing unit, on which the laser beam 460 is emitted to the photoreceptor 462, is adjusted by a tilt adjuster 467 (FIGS. 2, 4, and 5). By changing the tilt of the laser writing unit and adjusting the tilt of the laser trajectory to the photoreceptor 462 with the tilt adjuster, skew correction by a mechanical mechanism is executed.

The developing unit 463 supplies a toner of a predetermined color (Y, M, C, or K) onto the exposed photoreceptor 462 to develop the electrostatic latent image formed on the photoreceptor 462.

The primary transfer roller 464 is provided to face the photoreceptor 462. A primary transfer bias having a polarity opposite to that of the toner is applied to the primary transfer roller 464. By crimping a predetermined position on the intermediate transfer belt 465 onto the photoreceptor 462, the toner image formed on the photoreceptor 462 is transferred (primarily transferred) to the intermediate transfer belt 465. The primary transfer rollers 464 of Y, M, C, and K sequentially crimp predetermined positions on the intermediate transfer belt 465 onto the photoreceptor 462. As a result, a color toner image, where layers of respective colors are superimposed, is written on the intermediate transfer belt 465.

The intermediate transfer belt 465 is a semi-conductive endless belt suspended and rotatably supported by a plurality of rollers. The intermediate transfer belt 465 is rotationally driven with the rotation of the rollers, so that the toner image written is conveyed to the secondary transfer roller 466.

A bias having a polarity opposite to that of the toner is applied to the secondary transfer roller 466 to convey the conveyed recording material S in a hold state. As a result, the color toner image written on the intermediate transfer belt 465 is transferred (secondarily transferred) to the recording material S.

The color shift detection sensor 45 detects the position of the toner image of each color formed on the intermediate transfer belt 465.

The color shift detection sensor 45 is disposed on the intermediate transfer belt 465, and includes a light source, an image sensor that detects a toner image, and the like. In the color shift detection sensor 45, the image sensor that detects a toner image on the intermediate transfer belt 465 is arranged on a line orthogonal to the moving direction of the intermediate transfer belt 465.

In detecting the positional shift of the toner image of each color, a toner image of each color having a pattern (registration pattern), such as a straight line or a figure, that is determined in advance by an image forming operation, is first transferred to the intermediate transfer belt 465. Then, the color shift detection sensor 45 reads the toner image of each color and detects a transfer position of the toner image. Then, the color shift detection sensor 45 sends the detected transfer position of the toner image to the controller 41. The controller 41 detects the positional shift of the toner image of each color on the basis of the position of the toner image.

The fixing unit 47 heats and applies pressure to the toner image transferred to the recording material S to fix the toner image to the recording material S. The fixing unit 47 includes a fixing roller 471 incorporating a halogen heater or the like, and a pressure applying roller 472 as a pressure applying member that presses the fixing roller 471, the pressure applying roller 472 being arranged at a position facing the fixing roller 471 with the recording material conveyance path interposed therebetween. The fixing unit 47 also includes a temperature sensor for detecting the temperature of the fixing roller 471. The fixing unit 47 fixes, in a nip portion formed between the fixing roller 471 and the pressure applying roller 472, the toner image on the recording material S by heating and applying pressure to the toner image while holding and conveying the recording material S to which the toner image has been transferred.

In order to adjust a nip pressure of the nip portion between the fixing roller 471 and the pressure applying roller 472, release pressure contact, and the like, the fixing unit 47 includes a non-illustrated position change mechanism that adjusts the position of the fixing roller 471.

The recovery adjuster 50 is installed, in the conveyance direction of the recording material S, on the downstream side of the image forming apparatus 40 and on the upstream side of the recovery apparatus 60. The recovery adjuster 50 is an apparatus that conveys the recording material S conveyed from the image forming apparatus 40 to the recovery apparatus 60. In order to absorb a speed difference between the conveyance speed of the recording material S in the image forming apparatus 40 and the conveyance speed of the recording material S in the recovery apparatus 60, the recovery adjuster holds the recording material S in a slack state, and adjusts the ejection of the recording material S from the image forming apparatus 40.

The recovery apparatus 60 includes a paper ejector that winds, at a constant speed, the recording material S conveyed from the recovery adjuster 50 by a support shaft 61 via a plurality of rollers.

[System Block Diagram of Image Forming Apparatus]

Next, FIG. 2 illustrates a block diagram of an example of the configuration of the image forming apparatus 40.

As illustrated in FIG. 2, the image forming apparatus 40 includes the paper feeder 10, the controller 41, the operation display 42, the conveyor 44, the color shift detection sensor 45, the image former 46, the tilt adjuster 467, the fixing unit 47, and a nonvolatile memory 48.

The controller 41 of the image forming apparatus 40 includes, for example, a central processing unit (CPU), a random access memory (RAM), and a read only memory (ROM) (they are not illustrated). The CPU of the controller 41 reads various processing programs stored in the ROM, develops the programs in the RAM, and according to the developed programs, comprehensively controls the operations of respective units of the image forming apparatus 40, such as the paper feeder 10, the operation display 42, the conveyor 44, the color shift detection sensor 45, the image former 46, the fixing unit 47, and the nonvolatile memory 48, that are connected via a system bus of the image forming apparatus 40.

The nonvolatile memory 48 stores programs and the like to be executed by the controller 41, and is used as a work area for the controller 41. The nonvolatile memory 48 also stores image forming conditions set in an image forming job, recording material information including the size, type, and the like of the recording material S, and the like. Furthermore, the nonvolatile memory 48 stores information such as the position of the toner image of each color detected by the color shift detection sensor 45 and the color shift amount calculated on the basis of the position of the toner image.

The controller 41 also acquires image data from the input job information to perform image processing. The controller 41 performs image processing, such as shading correction, image density adjustment, or image compression, on the acquired image data if necessary. Then, the image data processed by the controller 41 is transmitted to the image former 46.

The conveyor 44 conveys the recording material S fed from the paper feeder 10 to the image former 46, the fixing unit 47, and the like on the basis of the control by the controller 41.

The image former 46 receives the image data subjected to the image processing by the controller 41. On the basis of the image data, the image former 46 forms an image on the recording material S conveyed to the image former 46 by the conveyor 44.

In the image former 46, the tilt adjuster 467 adjusts the angle of the laser writing unit according to an operation amount of the tilt adjuster 467 that is calculated by the controller 41, whereby skew correction is performed by a mechanical mechanism.

According to an instruction by a display signal input from the controller 41, the operation display 42 displays, on its display screen, the states of various operation buttons and devices, the operating state of each function, and the like. Furthermore, the operation display 42 receives an input of data by a user's operation, such as various instructions, characters, or numbers, and outputs the input signal to the controller 41.

[Functional Configuration of Controller]

Figure 3:
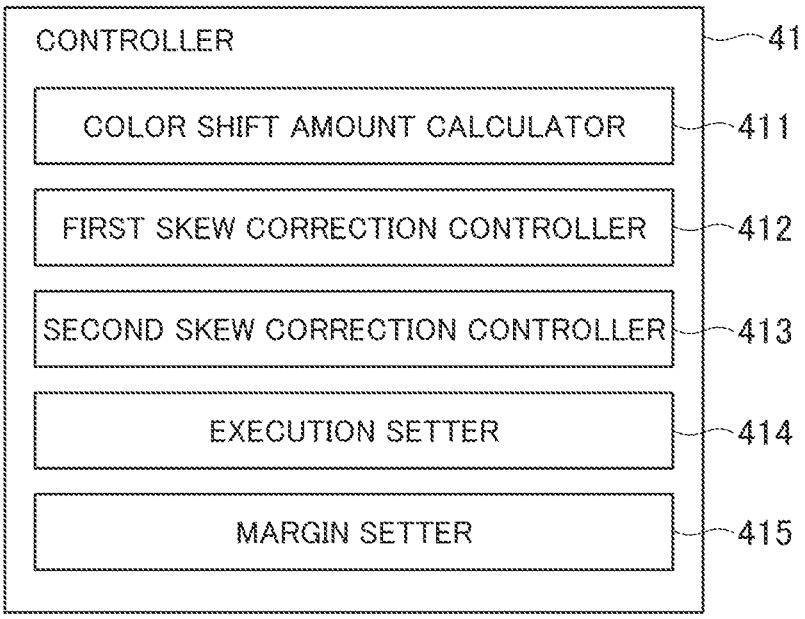
FIG. 3 is a functional block diagram of a controller of the image forming apparatus.

Next, a functional configuration of the controller of the image forming apparatus will be described. FIG. 3 is a functional block diagram of the controller.

Next, a functional configuration of the controller 41 of the above image forming apparatus 40 will be described. FIG. 3 is a functional block diagram of the controller 41 of the image forming apparatus 40. The controller 41 illustrated in FIG. 3 includes a color shift amount calculator 411, a first skew correction controller 412, a second skew correction controller 413, an execution setter 414, and a margin setter 415.

(Color Shift Amount Calculator)

On the basis of the position of the toner image of each color on the intermediate transfer belt 465 that has been detected by the color shift detection sensor 45, the color shift amount calculator 411 calculates a color shift amount of the image of each color in the image former. Furthermore, the color shift amount calculator 411 compares the calculated color shift amount with a color shift residual target value that is a color shift amount target value set in advance, and determines which of the calculated color shift amount and the color shift residual target value is larger than the other.

(Skew Correction Controller)

The first skew correction controller 412 and the second skew correction controller 413 control color shift correction of skew (skew correction) in the image forming apparatus 40. In the image forming apparatus 40, after the control of the skew correction (first skew correction) by the first skew correction controller 412 is executed, skew correction (second skew correction) by the second skew correction controller 413 is executed. As a result, in the image forming apparatus 40, the second skew correction is executed on the color shift amount (color shift residual) of the image that has been corrected by the first skew correction. As described above, by executing the second skew correction after the color shift amount (color shift residual) is reduced by the first skew correction, a correction amount for the second skew correction can be reduced.

Note that when the initial color shift amount calculated by the color shift amount calculator 411 is equal to or more than a minimum unit (resolution) that can be corrected by the first skew correction, the first skew correction controller 412 executes the first skew correction. Therefore, when the initial color shift amount is less than the minimum unit (resolution) that can be corrected by the first skew correction, the skew correction in the image forming apparatus 40 can also be completed by executing only the second skew correction by the second skew correction controller 413 without performing the first skew correction by the first skew correction controller 412.

In addition, the image forming apparatus 40 may have a configuration in which a user can arbitrarily set whether or not the second skew correction by the second skew correction controller is executed. The skew correction in the image forming apparatus 40 can also be completed by executing only the first skew correction by the first skew correction controller 412 without performing the second skew correction by the second skew correction controller 413 by, for example, stopping the execution of the second skew correction.

(First Skew Correction Controller)

The first skew correction controller 412 controls the drive of the tilt adjuster 467 to adjust the tilt of the laser writing unit, whereby the skew correction (first skew correction) is executed. That is, the first skew correction controller 412 controls the skew correction by the mechanical mechanism in the image forming apparatus 40.

The first skew correction controller 412 executes the first skew correction such that the color shift amount calculated by the color shift amount calculator 411 becomes less than a first color shift residual target value set in advance. The first color shift residual target value is the minimum unit (resolution) that can be corrected by the first skew correction. By performing the first skew correction such that the color shift residual after the first skew correction is equal to or less than the first color shift residual target value, the correction by the first skew correction is maximized in the skew correction. As a result, a margin between the images can be minimized.

Alternatively, the first skew correction controller 412 may count the number of times of correction for the first skew correction, and execute the first skew correction up to a predetermined number of times of correction. When the first color shift residual target value is not set, the first skew correction controller 412 repeatedly executes the first skew correction until the number of times of the executed first skew correction reaches a predetermined first number of times of correction. As a result, more correction by the first skew correction, among the skew correction, can be executed, and the margin between images can be further reduced.

(Skew Correction by First Skew Correction Controller)

Figure 6:
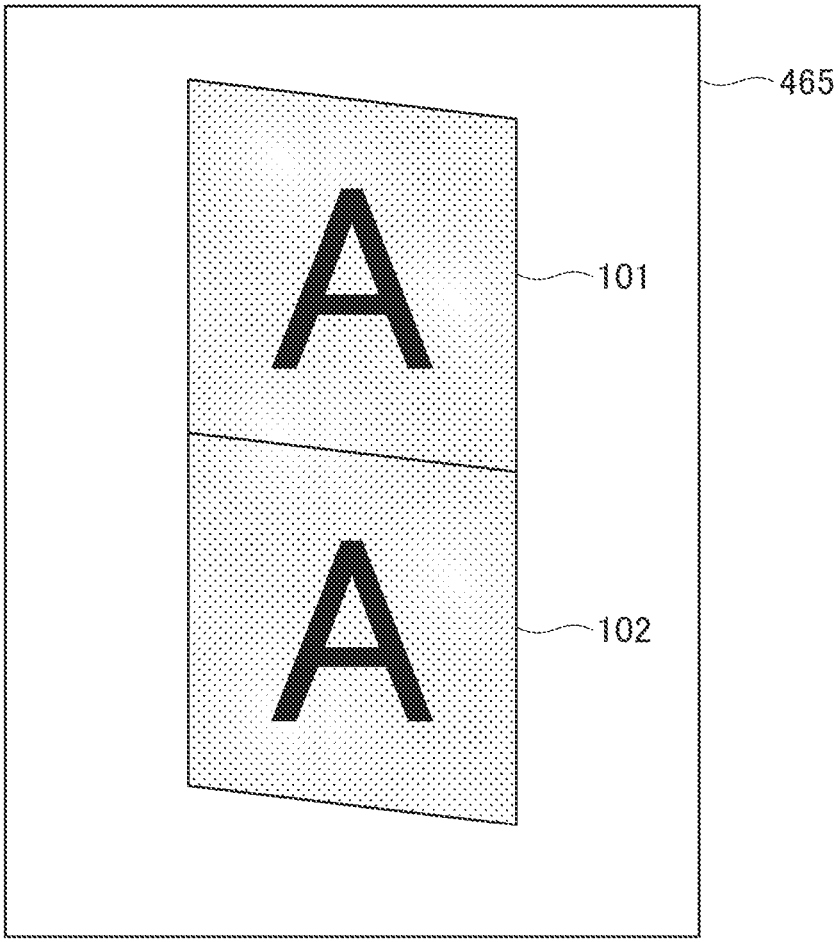
FIG. 6 is a diagram for explaining the control of the first skew correction by the mechanical mechanism by the first skew correction controller.

FIGS. 4, 5, and 6 are diagrams for explaining the control of the first skew correction by the mechanical mechanism by the first skew correction controller 412.

FIG. 4 is a diagram illustrating, before the first skew correction is performed, the states of a laser writing unit 468, the tilt adjuster 467 that adjusts the tilt of the laser writing unit 468, and the photoreceptor 462. Before the first skew correction, the laser writing unit 468 emits the laser beam 460 perpendicularly to the surface of the photoreceptor 462. Therefore, a laser trajectory 469 parallel to a direction (main scanning direction) orthogonal to the rotation direction is formed on the surface of the photoreceptor 462. As a result, a parallel electrostatic latent image not subjected to the skew correction is formed on the photoreceptor 462.

FIG. 5 is a diagram illustrating, in a state where the first skew correction has been performed, the states of the laser writing unit 468, the tilt adjuster 467 that adjusts the tilt of the laser writing unit 468, and the photoreceptor 462.

The tilt adjuster 467 is driven by the first skew correction controller 412, and the laser writing unit 468 is tilted obliquely with respect to the main scanning direction of the photoreceptor 462. When the laser beam 460 is emitted from the laser writing unit 468 to the photoreceptor 462 in this state, the laser trajectory 469 tilted from a line parallel to the main scanning direction is formed on the surface of the photoreceptor 462. As a result, a tilted electrostatic latent image subjected to the skew correction is formed on the photoreceptor 462. Then, toner is supplied from the developing unit 463 to the electrostatic latent image formed to be tilted, so that an electrostatic latent image subjected to the skew correction is developed on the photoreceptor 462, which is transferred (primarily transferred) to the intermediate transfer belt 465.

With the control by the first skew correction controller 412 described above, a toner image subjected to the skew correction (first skew correction) by the mechanical mechanism can be transferred to the intermediate transfer belt 465.

FIG. 6 illustrates a toner image 101 and a toner image 102 that are corrected by the first skew correction and transferred to the intermediate transfer belt 465. In FIG. 6, the toner image 101 is first transferred to the intermediate transfer belt 465, and the toner image 102 is transferred after the toner image 101. As illustrated in FIG. 6, the first skew correction is performed by the mechanical mechanism by the first skew correction controller 412, and the toner image 101 and the toner image 102 formed obliquely with respect to the main scanning direction are continuously transferred without a margin formed on the intermediate transfer belt 465.

As described above, the first skew correction by the mechanical mechanism is performed and a toner image is transferred (secondarily transferred) to the recording material S, whereby it is possible to continuously form images without forming a margin between the pages or the images. Therefore, in the first skew correction performed under the control by the first skew correction controller 412, discarding (waste paper) of a margin between pages or between images does not occur.

(Second Skew Correction Controller)

The controller 41 acquires image data from the input job information to perform image processing. The controller 41 performs image processing, such as shading correction, image density adjustment, or image compression, on the acquired image data if necessary. On the basis of the image data subjected to the image processing by the controller 41, the image former 46 then forms an image on each page of the recording material S by an electrophotographic method.

When the controller 41 performs the image processing on the image data, the second skew correction controller 413 executes skew correction (second skew correction). That is, in the image forming apparatus 40, the second skew correction controller 413 controls the skew correction by the image processing.

The second skew correction controller 413 performs the second skew correction on a color shift amount (color shift residual) of the image after the control of the first skew correction performed by the first skew correction controller 412. The second skew correction controller 413 executes the second skew correction such that the color shift residual becomes less than a second color shift residual target value set in advance. The second color shift residual target value is preferably a minimum unit (resolution) that can be corrected by the second skew correction. By performing the second skew correction such that the color shift residual after the second skew correction is equal to or less than the second color shift residual target value, skew correction with high accuracy can be performed.

Alternatively, the second skew correction controller 413 may count the number of times of correction of the second skew correction, and execute the second skew correction up to a predetermined number of times of correction. When the second color shift residual target value is not set, the second skew correction controller 413 repeatedly executes the second skew correction until the number of times of the executed second skew correction reaches a predetermined second number of times of correction. As a result, the second skew correction controller 413 can perform skew correction with high accuracy.

The first skew correction described above is correction by the mechanical mechanism, and follows the resolution of the operation amount of a motor or the like constituting the tilt adjuster 467. Therefore, the minimum unit (resolution) of the correction is about 10 μm. On the other hand, the second skew correction is correction by the image processing, so that the image can be corrected in units of pixels. Therefore, correction in a minimum unit (resolution) of several μm or less can be performed. Therefore, skew correction with high accuracy can be performed by performing the second skew correction.

(Skew Correction by Second Skew Correction Controller)

Figure 7:
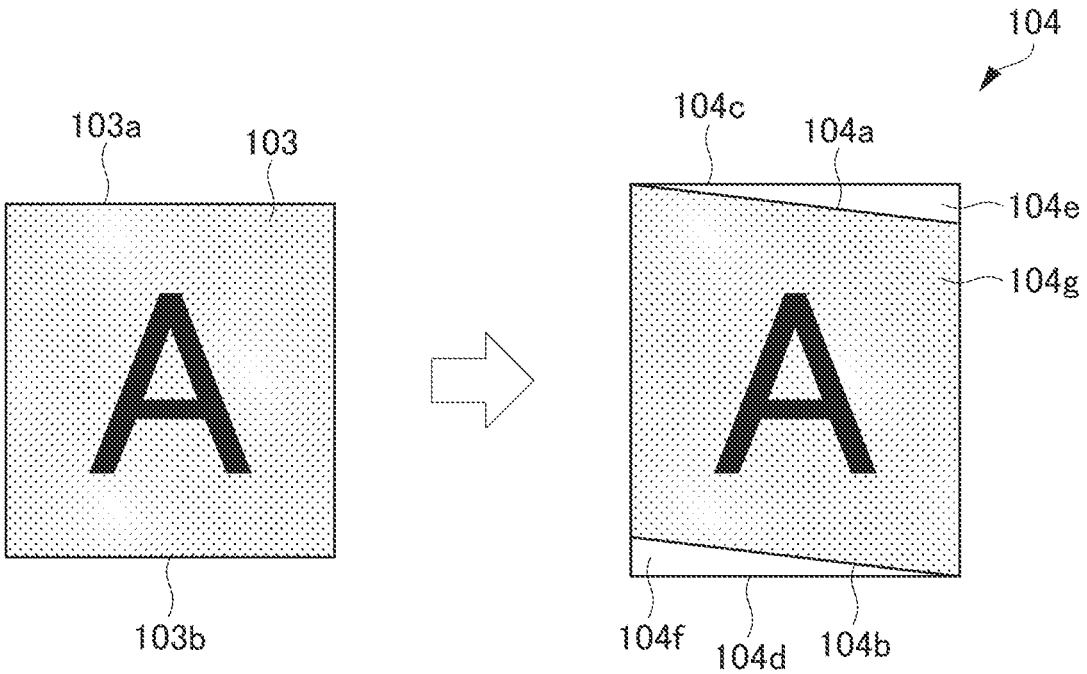
FIG. 7 is a diagram for explaining control of second skew correction by image processing by a second skew correction controller.
Figure 8:
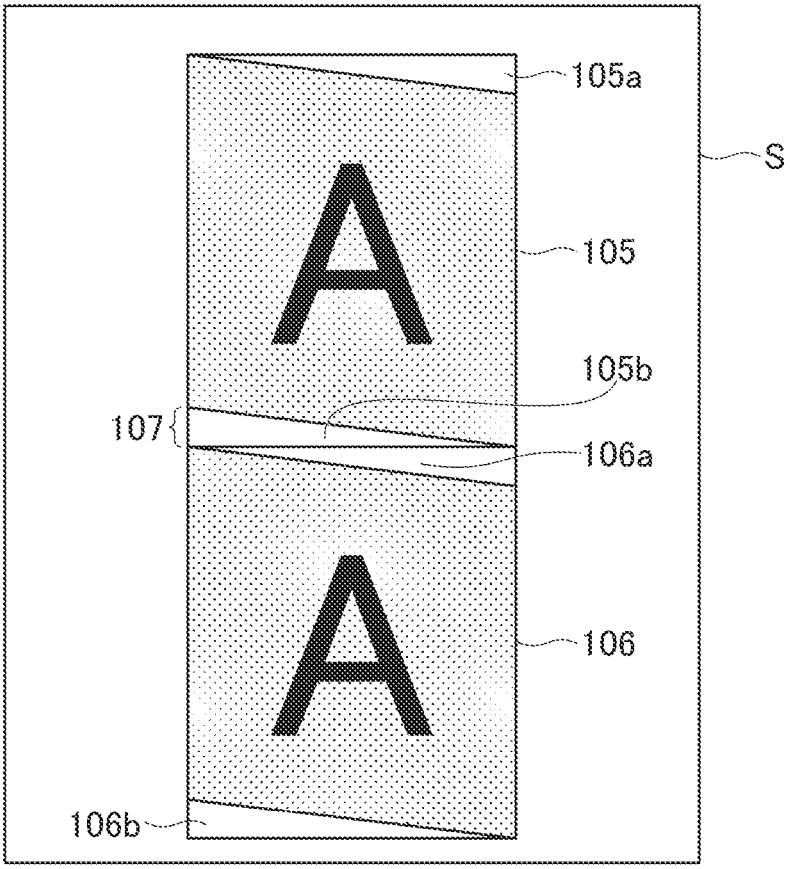
FIG. 8 is a diagram for explaining the control of the second skew correction by the image processing by the second skew correction controller.

FIGS. 7 and 8 are diagrams for explaining the control of the second skew correction by the image processing by the second skew correction controller 413.

FIG. 7 is a diagram illustrating the states of image data 103 before the second skew correction is performed and image data 104 after the second skew correction is performed. In the image data 103 and the image data 104 illustrated in FIG. 7, the vertical direction in the drawing is a direction (sub-scanning direction) parallel to the conveyance direction of the recording material S when the image is formed, while the horizontal direction is a direction (main scanning direction) perpendicular to the conveyance direction of the recording material S when the image is formed.

In the image data 103 before the second skew correction is performed, an edge 103*a* on the front end side of the image data 103 and an edge 103*b* on the rear end side thereof are formed at positions parallel to the main scanning direction.

On the other hand, in the image data 104 after the second skew correction is performed, an image portion 104*g*, tilted with respect to the main scanning direction according to a color shift amount, is generated. In addition, the entire length, in the sub-scanning direction, of the image data 104 generated by the second skew correction is enlarged. That is, in the image data 104, an edge 104*a* on the front end side of the tilted image portion 104*g* and an edge 104*b* on the rear end side thereof are formed at positions oblique with respect to the main scanning direction. A margin 104*e* is formed in an area between the edge 104*a* on the front end side of the image portion 104*g* and an edge 104*c* on the front end side of the image data 104. In addition, a margin 104*f* is formed in an area between the edge 104*b* on the rear end side of the image portion 104*g* and an edge 104*d* on the rear end side of the image data 104.

As described above, the second skew correction by the second skew correction controller 413 enlarges the image data 104 in the sub-scanning direction by the amount that the image portion 104*g* is tilted with respect to the main scanning direction. Then, the margins 104*e* and 104*f*, where the image portion 104*g* is not formed, are created in areas on the front end side and on the rear end side of the enlarged image data 104.

Therefore, when the second skew correction is performed by the image processing by the second skew correction controller 413, an area, including the image portion 104*g* formed obliquely with respect to the main scanning direction and the margins 104*e* and 104*f*, becomes one page of the image data 104.

FIG. 8 illustrates an image 105 and an image 106 that are corrected by the second skew correction and formed on the recording material S. In FIG. 8, the image 105 is first formed on (secondarily transferred and fixed to) the recording material S, and the image 106 is formed after the image 105.

As illustrated in FIG. 8, the image 105, subjected to the second skew correction by the image processing by the second skew correction controller 413, has a margin 105*a* formed on the front end side and a margin 105*b* formed on the rear end side. Similarly, the image 106 has a margin 106*a* formed on the front end side and a margin 106*b* formed on the rear end side. The margin 105*a* and the margin 106*a* correspond to the margin 104*e* on the front end side of the image data 104 illustrated in FIG. 7 described above. The margin 105*b* and the margin 106*b* correspond to the margin 104*f* on the rear end side of the image data 104 illustrated in FIG. 7 described above.

As described above, when the second skew correction is performed, a margin 107, including the margin 105*b* and the margin 106*a*, is formed between the image 105 and the image 106. As a result, when the second skew correction is performed under the control by the second skew correction controller 413 in the image forming apparatus 40, a margin is formed between the formed images or between respective pages when the images are continuously formed on the recording material S, (Execution Setter)

The execution setter 414 receives setting of enabling or disabling the execution of the second skew correction by the second skew correction controller 413. The execution setter 414 receives setting, for example, by an operation by a user or the like via the operation display 42 of the image forming apparatus 40, and sets the execution of the second skew correction to be enabled or disabled. Then, when the setting of the second skew correction is enabled in the execution setter 414, the second skew correction controller 413 executes the second skew correction by the image processing. When the setting of the second skew correction is disabled in the execution setter 414, the second skew correction controller 413 does not execute the second skew correction by the image processing.

In order to make the margin between the images to be continuously formed on the recording material S zero, the image processing by the second skew correction cannot be used. When an output object is, for example, like masking tape, the margin between the images needs to be 0, so that it is necessary to disable the image processing by the second skew correction.

Therefore, it is desirable to always enable the first skew correction by the mechanical mechanism, but it is necessary to set, for each job, ON/OFF of the second skew correction by the image processing.

The execution setter 414 can perform skew correction without creating a margin between the images by disabling the second skew correction by the second skew correction controller 413. When the setting of the second skew correction is disabled in the execution setter 414, the controller 41 performs only the first skew correction by the first skew correction controller 412.

(Margin Setter)

The margin setter 415 sets a margin amount between the images subjected to the skew correction to a constant value. The margin setter 415 sets, to the margin amount between the images, a margin amount of one type that has been set in advance (fixed value), a value selected by a user from a plurality of margin amounts set in advance (selected value), or a value arbitrarily set as the margin amount by a user or the like (arbitrary value).

When a margin amount of one type has been set in advance, for example, when the image forming apparatus 40 has a fixed value of 1 mm as the margin amount, the margin setter 415 has 1 mm set in advance as the fixed value for the margin amount. Therefore, the margin setter 415 sets the fixed value set in advance to the margin amount.

When a user selects a value from a plurality of margin amounts set in advance, the margin setter 415 presents (operation display 42), for example, selectable values of three types of "1 mm, 2 mm, or 3 mm" that are held as selectable margin amounts, to the user or the like. Then, the margin setter 415 receives selection for the presented values by the user or the like, and sets the value that has been selected (selected value) as the margin amount.

When a user or the like arbitrarily sets a value as the margin amount, the margin setter 415 receives, on the operation display 42, an input of a value that is arbitrary (arbitrary value) by the user or the like. Then, the margin setter 415 sets the arbitrary value input by the user or the like as the margin amount.

In the second skew correction described above, the margin 107 (margins 105*b*, 106*a*) due to the image processing is created between the image 105 and the image 106 that are continually formed on the recording material S, as illustrated in FIG. 8. The amount of the margin 107 (margins 105*b*, 106*a*) created in the second skew correction varies depending on a correction factor in the image processing.

Figure 9:
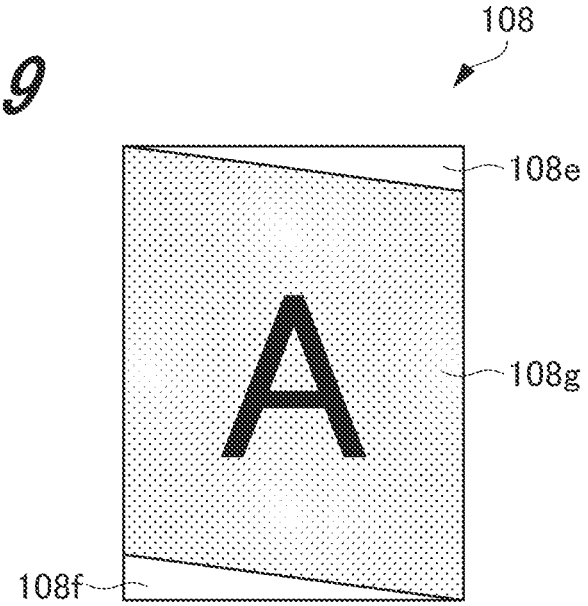
FIG. 9 is a diagram illustrating image data having a different correction factor in the second skew correction.
Figure 10:
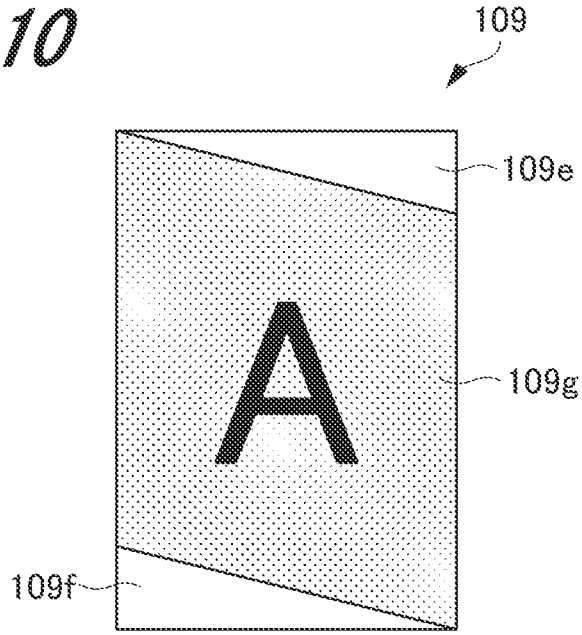
FIG. 10 is a diagram illustrating image data having a different correction factor in the second skew correction.

In the second skew correction, image data having different correction factors in the image processing are illustrated in FIG. 9 and FIG. 10. FIG. 9 illustrates image data 108 occurring when the correction factor of the skew correction is small (tilt is small) in the second skew correction. FIG. 10 illustrates image data 109 occurring when the correction factor of the skew correction is large (tilt is large) in the second skew correction.

In the image data 108 after the second skew correction is performed, an image portion 108*g*, tilted with respect to the main scanning direction according to the color shift amount, is generated, as illustrated in FIG. 9. The entire length, in the sub-scanning direction, of the image data 108 generated by the second skew correction is enlarged according to the magnitude of the correction factor. A margin 108*e* is formed on the front end side of the image portion 108*g*, and a margin 108*f* is formed on the rear end side.

Similarly, in the image data 109 after the second skew correction is performed that is illustrated in FIG. 10, an image portion 109*g*, tilted with respect to the main scanning direction according to the color shift amount, is generated. The entire length, in the sub-scanning direction, of the image data 109 generated by the second skew correction is enlarged according to the magnitude of the correction factor. A margin 109*e* is formed on the front end side of the image portion 109*g*, and a margin 109*f* is formed on the rear end side.

When the image data 108 and the image data 109 are compared, the image data 109 has a larger correction factor of the second skew correction and has a larger tilt of the image portion 109*g*. Therefore, the areas of the margins 109*e* and 109*f* that are respectively formed on the front end side and on the rear end side of the image portion 109*g* are formed to be larger in the sub-scanning direction than the areas of the margins 108*e* and 108*f* that are respectively formed on the front end side and on the rear end side of the image portion 108*g* of the image data 108.

In the image data subjected to the second skew correction, like the image data 108 and the image data 109, the interval between the image portions continually formed on the recording material S is determined by the magnitude of the correction factor of the skew correction.

However, the color shift amount varies depending on the individual difference or internal temperature of the image forming apparatus 40. Therefore, if the margin amount between the image portions is set to a minimum value according to the correction factor of the second skew correction, the margin amount between the images varies every time the second skew correction is executed, not only by a difference due to an image forming apparatus that executes the job, but also even when the same image forming apparatus is used. If the margin amount between the images varies as described above, user convenience is decreased. In post-processing after images are formed, it is necessary to set, for example, a processing position or a cutting position according to the margin amount between the images. Therefore, if the margin amount varies every time the job is executed, post-processing needs to be set in each job, leading to an increase in user effort.

Therefore, even when the second skew correction is performed by the image processing by the second skew correction controller 413, the margin setter 415 sets the margin amount between the images continually formed on the recording material S to a constant value regardless of the correction factor of the image processing.

Figure 11:
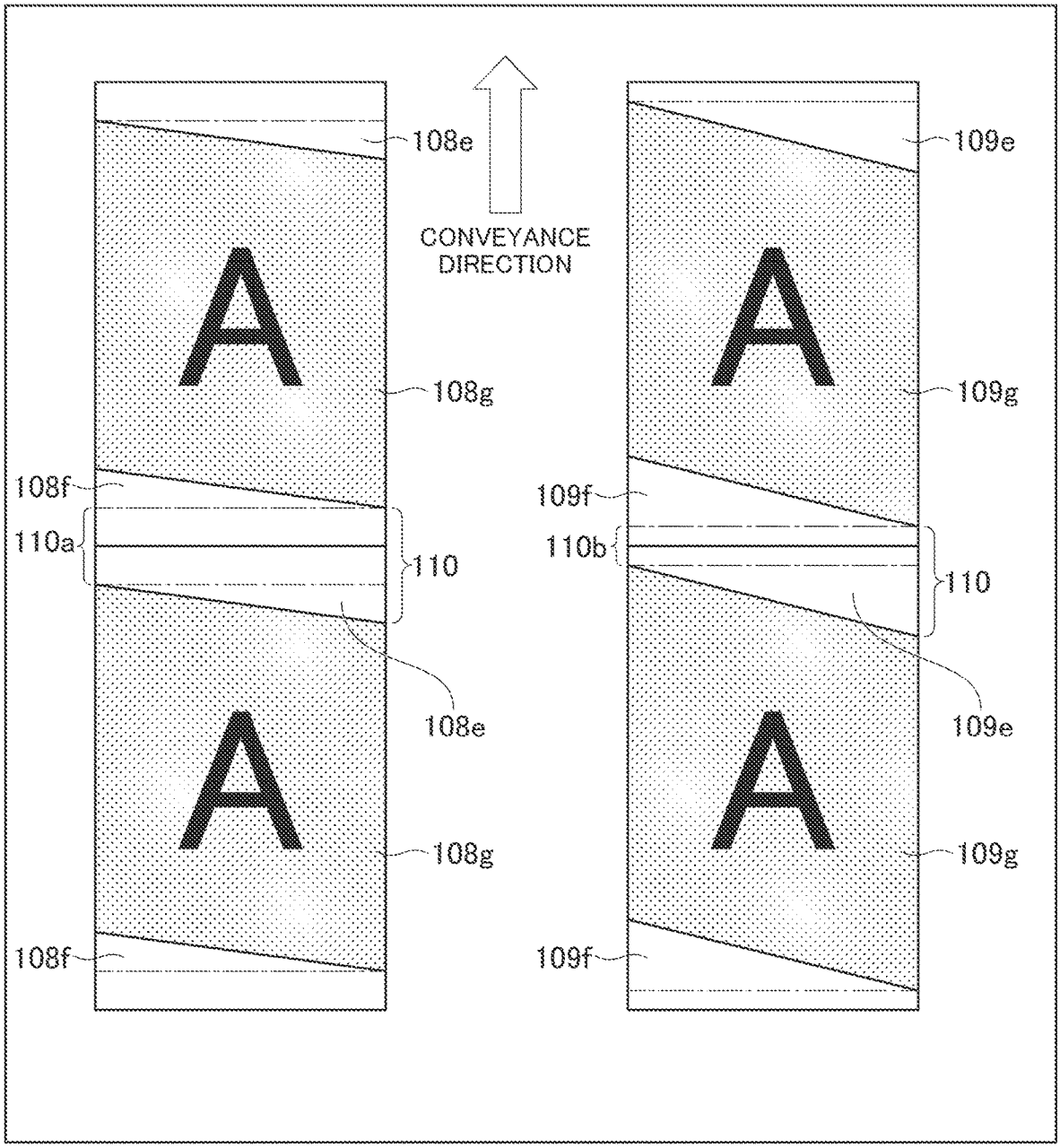
FIG. 11 is a diagram illustrating examples of image data when a margin amount is set to a constant value by a margin setter.

FIG. 11 illustrates examples of image data when the margin amount is set to a constant value. FIG. 11 illustrates examples when the image data 108 and the image data 109 in FIGS. 9 and 10 described above are respectively formed continually on the intermediate transfer belt 465 or the recording material S. In FIG. 11, the image portion 108*g* and the image portion 109*g* are continually lined up in the sub-scanning direction, respectively. The interval between the rearmost end and the foremost end, in the sub-scanning direction, of each of the image portion 108*g* and the image portion 109*g* is illustrated as a margin 110.

As illustrated in FIG. 11, when the image portion 108*g* is continually formed and when the image portion 109*g* is continually formed, distances, in the sub-scanning direction, of the margins 110 between the image portions 108*g* and between the image portions 109*g* are set to the same value. As described above, by setting the margin amounts of the margins 110 between the image portions 108*g* and between the image portions 109*g* to a constant value, the margin amount of the output object can be made constant without depending on a change in the margin amount created in the second skew correction for each job. Therefore, since the controller 41 includes the margin setter 415 in the image forming apparatus 40, it is possible to suppress a decrease in user convenience due to a variation in the margin amount in the post-processing and the like.

The value of the margin amount of the output object that is set by the margin setter 415 is reflected in the control of the image processing in the second skew correction by the second skew correction controller 413.

The second skew correction controller 413 sets the margin between the images of the image date generated in the second skew correction to a constant value set by the margin setter 415. For example, when in the second skew correction, the margin amount created by a correction factor according to a color shift amount is less than the constant value set by the margin setter 415, the second skew correction controller 413 inserts, between the images, a margin amount according to a difference with the value of the margin amount that has been set, and generates image data such that the margin amount becomes a constant value.

The margin 110 between the image portions 108*g* illustrated in FIG. 11 is formed by inserting a margin 110*a* between the margin 108*e* and the margin 108*f*. In addition, the margin 110 between the image portions 109*g* is formed by inserting a margin 110*b* between the margin 109*e* and the margin 109*f*. As described above, the image data is generated by further inserting the margins 110*a* and 110*b* respectively between the margins 108*e* and 108*f* and between the margins 109*e* and 109*f* created by the image processing, so that the margin amount between the images becomes the fixed value that has been set.

In addition, the second skew correction controller 413 limits the skew correction factor of the image processing by the second skew correction controller 413 so as not to exceed the value set by the margin setter 415. When the correction factor is set in accordance with the color shift amount in the second skew correction, there is a possibility that a margin amount created in the image data will exceed the constant value set by the margin setter 415. Therefore, the second skew correction controller 413 limits the correction factor in the second skew correction to a correction factor at which the margin amount created in image data is equal to or less than the constant value set by the margin setter 415, thereby generating the image data.

Note that in the margin amount set by the margin setter 415, an upper limit value of the margin amount that can be arbitrarily set by a user or the like is preferably equal to or less than the first color shift residual target value (T1) in the first skew correction. When the correction by the first skew correction is maximized, the maximum value of the margin amount created by the image processing of the second skew correction is equal to or less than the first color shift residual target value (T1). Therefore, by setting the margin amount to be equal to or less than the first color shift residual target value (T1), the margin amount created in the color shift correction can be suppressed.

[Processing Method 1 of Color Shift Correction (Skew Correction)]

Figure 12:
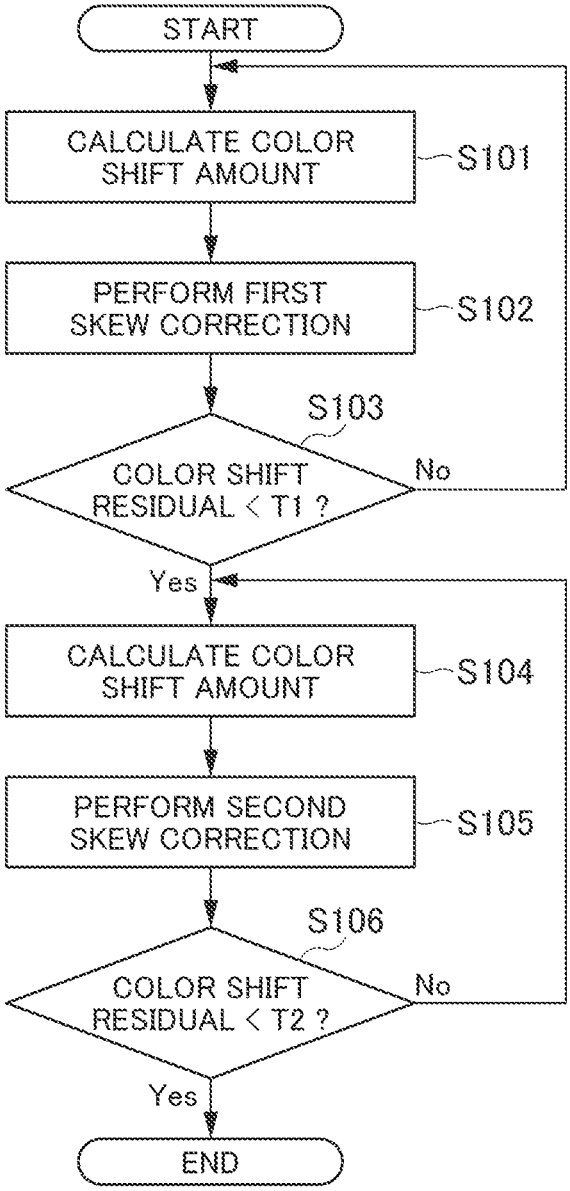
FIG. 12 is a flowchart of a first processing method of skew correction.

Next, a specific processing method of the color shift correction (skew correction) by the above image forming apparatus will be described. FIG. 12 illustrates a flowchart of a first processing method of the skew correction performed by the image forming apparatus.

First, the image forming apparatus 40 starts image formation for testing in order to correct color shift. Then, the color shift amount calculator 411 calculates a color shift amount on the basis of the position of the toner image transferred to the intermediate transfer belt 465 that has been detected by the color shift detection sensor 45 (step S101).

Next, the first skew correction controller 412 performs the first skew correction on the basis of the color shift amount calculated by the color shift amount calculator 411 (step S102). The first skew correction controller 412 performs skew correction by the mechanical mechanism of the image forming apparatus 40, as described above.

After the first skew correction, the color shift amount calculator 411 calculates a color shift amount (color shift residual) after the first skew correction, and determines whether or not the color shift residual is less than the first color shift residual target value (T1) (step S103). In this determination, the image forming apparatus 40 first performs image formation for testing again, and the color shift detection sensor 45 detects the position of the toner image. Then, the color shift amount calculator 411 calculates a color shift amount (color shift residual) after the first skew correction on the basis of the position of the toner image after the first skew correction that has been detected by the color shift detection sensor 45. The color shift amount calculator 411 further determines whether or not the color shift residual after the first skew correction is less than the first color shift residual target value (T1) that is a minimum unit (resolution) that can be corrected by the first skew correction.

When the color shift residual is not less than the first color shift residual target value (T1) (No in the step S103), the controller 41 repeats the processing of the step S101 and the step S102. The first skew correction is repeated until the color shift residual after the first skew correction becomes less than the first color shift residual target value (T1).

When the color shift residual is less than the first color shift residual target value (T1) (Yes in the step S103), the color shift amount calculator 411 calculates a color shift amount after the first skew correction (step S104).

Next, the second skew correction controller 413 performs the second skew correction on the basis of the color shift amount after the first skew correction that has been calculated by the color shift amount calculator 411 (step S105). The second skew correction controller 413 performs the skew correction by the image processing.

After the second skew correction, the color shift amount calculator 411 calculates a color shift amount (color shift residual) after the second skew correction, and determines whether or not the color shift residual is less than the second color shift residual target value (T2) (step S106). In this determination, the image forming apparatus 40 first performs image formation for testing again, and the color shift detection sensor 45 detects the position of the toner image. Then, the color shift amount calculator 411 calculates a color shift amount (color shift residual) after the second skew correction on the basis of the position of the toner image after the second skew correction that has been detected by the color shift detection sensor 45. The color shift amount calculator 411 further determines whether or not the color shift residual after the second skew correction is less than the second color shift residual target value (T2) that is a minimum unit (resolution) that can be corrected by the second skew correction.

When the color shift residual is not less than the second color shift residual target value (T2) (No in the step S106), the controller 41 repeats the processing of the step S104 and the step S105. The second skew correction is repeated until the color shift residual after the second skew correction becomes less than the second color shift residual target value (T2).

When the color shift residual is less than the second color shift residual target value (T2) (Yes in the step S106), the processing according to the present flowchart is ended.

In the above processing, the first skew correction is repeated until the color shift residual after the first skew correction becomes less than the first color shift residual target value. As a result, the correction by the first skew correction creating no margin between images is maximized Thereafter, the second skew correction with high resolution is performed. As a result, the amount of the second skew correction creating a margin can be minimized, and the creation of the margin can be reduced. Furthermore, by performing the second skew correction with high resolution after the first skew correction with low resolution, color shift correction with high accuracy can be performed.

[Processing Method 2 of Color Shift Correction (Skew Correction)]

Next, a second processing method of color shift correction (skew correction) by the above image forming apparatus will be described. In the first processing method described above, the color shift residual is compared with the color shift residual target value to determine the completion of the skew correction. In the second processing method described below, the first skew correction and the second skew correction are repeated the number of times of correction that has been set in advance, thereby completing the skew correction.

Figure 13:
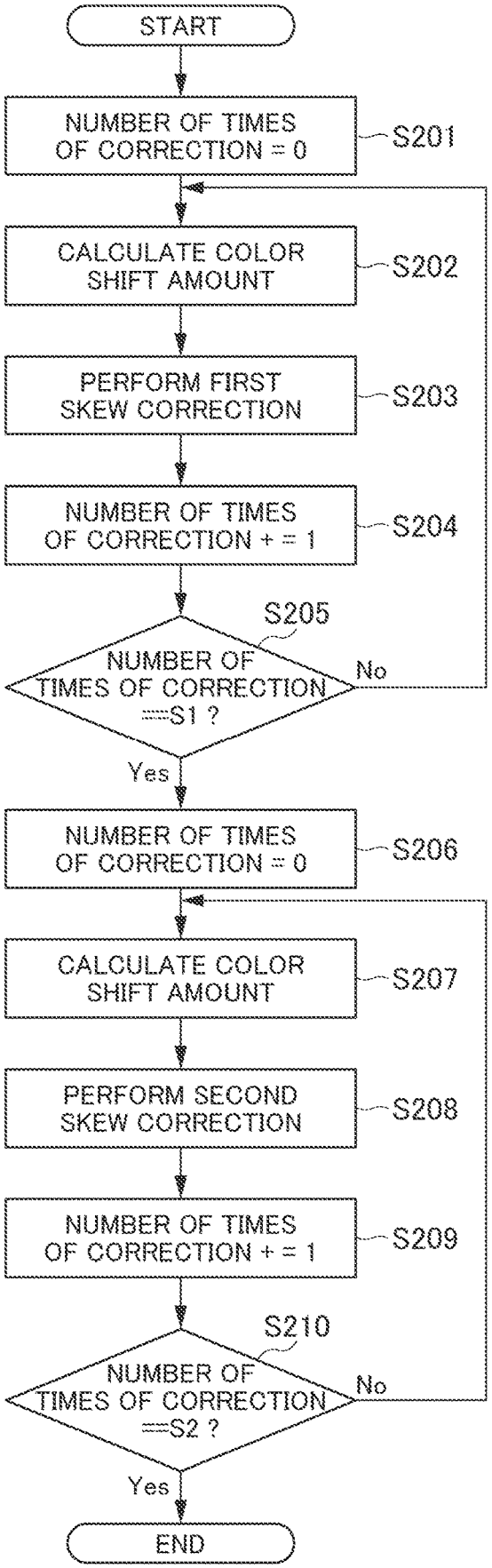
FIG. 13 is a flowchart of a second processing method of the skew correction.

FIG. 13 illustrates a flowchart of the second processing method of the skew correction performed by the image forming apparatus.

First, the first skew correction controller 412 sets the count of the number of times of correction of the first skew correction to 0 (step S201).

Next, the image forming apparatus 40 starts image formation for testing in order to correct color shift. The color shift amount calculator 411 calculates a color shift amount on the basis of the position of the toner image transferred to the intermediate transfer belt 465 that has been detected by the color shift detection sensor 45 (step S202).

Next, the first skew correction controller 412 performs the first skew correction on the basis of the color shift amount calculated by the color shift amount calculator 411 (step S203).

Then, the first skew correction controller 412 adds 1 to the count of the current number of times of correction of the first skew correction (step S204).

Next, the first skew correction controller 412 determines whether or not the current number of times of correction matches a first number of times of correction S1 set in advance (step S205).

When the current number of times of correction does not match the first number of times of correction S1 set in advance (No in the step S205), the controller 41 repeats the processing from the step S202 to the step S204. The first skew correction is repeated until the current number of times of correction of the first skew correction matches the first number of times of correction S1 set in advance.

When the current number of times of correction matches the first number of times of correction S1 set in advance (Yes in the step S205), the second skew correction controller 413 sets the count of the number of times of correction of the second skew correction to 0 (step S206).

Next, the color shift amount calculator 411 calculates a color shift amount after the first skew correction (step S207).

The second skew correction controller 413 performs the second skew correction on the basis of the color shift amount after the first skew correction that has been calculated by the color shift amount calculator 411 (step S208).

Then, the second skew correction controller 413 adds 1 to the count of the current number of times of correction of the second skew correction (step S209).

Next, the second skew correction controller 413 determines whether or not the current number of times of correction matches a second number of times of correction S2 set in advance (step S210).

When the current number of times of correction does not match the second number of times of correction S2 set in advance (No in the step S210), the controller 41 repeats the processing from the step S207 to that step S209. The second skew correction is repeated until the current number of times of correction of the second skew correction matches the second number of times of correction S2 set in advance.

When the current number of times of correction matches the second number of times of correction S2 set in advance (Yes in the step S210), the processing according to the present flowchart is ended.

In the above processing, after the first skew correction creating no margin between images is repeatedly executed the first number of times of correction S1, the second skew correction with high resolution is repeatedly executed the second number of times of correction S2. As a result, the creation of a margin can be reduced, and color shift correction with high accuracy can be performed.

[Processing Method 3 of Color Shift Correction (Skew Correction)]

Next, a third processing method of color shift correction (skew correction) by the above image forming apparatus will be described. In the first processing method and the second processing method described above, the skew correction is completed by repeating the first skew correction and the second skew correction. In the third processing method described below, image formation is performed after the execution setter 414 confirms whether the execution of the second skew correction by the second skew correction controller 413 is enabled or disabled.

Figure 14:
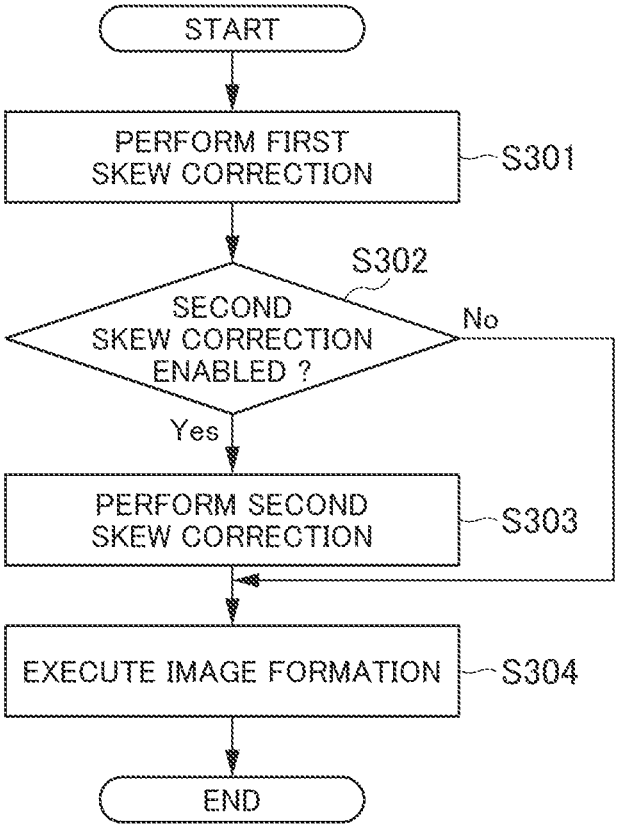
FIG. 14 is a flowchart of a third processing method of the skew correction.

FIG. 14 illustrates a flowchart of the third processing method of the skew correction performed by the image forming apparatus.

First, the first skew correction controller 412 executes the processing from the step S101 to the step S103 illustrated in FIG. 12 described above, or the processing from the step S201 to the step S205 illustrated in FIG. 13, thereby executing the first skew correction (step S301).

Next, the execution setter 414 determines whether or not the execution of the second skew correction by an operation of a user or the like is enabled (step S302).

When the execution of the second skew correction is enabled (Yes in the step S302), the second skew correction controller 413 executes the processing from the step S104 to the step S106 illustrated in FIG. 12 described above, or the processing from the step S206 to the step S210 illustrated in FIG. 13, thereby executing the second skew correction (step S303).

When the execution of the second skew correction is not enabled (No in the step S302), or after the execution of the second skew correction of the step S303, the image forming apparatus 40 executes image formation in the image former 46 (step S304), and ends the processing according to the present flowchart.

[Processing Method 4 of Color Shift Correction (Skew Correction)]

Next, a fourth processing method of color shift correction (skew correction) by the above image forming apparatus will be described. In the fourth processing method described below, skew correction is executed again on a job on which the skew correction has been executed in the first processing method and the second processing method that have been described above.

Since the color shift amount always varies due to temperature change or the like in the image forming apparatus 40, it is necessary to perform the color shift correction again according to a change in the internal temperature or the like of the apparatus without the limitation on the number of times of the color shift correction to one. In the color shift correction for the second or subsequent time, a correction time is usually shortened by calculating a color shift amount using the correction value for the previous time as the initial value and executing the color shift correction.

A specific example of performing such color shift correction for the second time will be described. In the color shift correction by the image forming apparatus 40 in this example, the resolution of the first skew correction by the mechanical mechanism is set to 10 μm, and the resolution of the second skew correction by the image processing is set to 1 μm.

First, when the color shift amount is calculated to be 25 μm in the color shift correction for the first time, a color shift amount to be subjected to the first skew correction is 25 μm that is the entire of the calculated color shift amount. Then, the resolution of the first skew correction is 10 μm, so that a color shift amount that can be corrected by the first skew correction is 20 μm out of 25 μm that is the entire of the color shift amount.

Then, a color shift amount to be subjected to the second skew correction is 5 μm that is the color shift residual in the first skew correction.

Next, a case where the processing method according to the flowchart illustrated in FIG. 12 or FIG. 13 described above is executed when the color shift correction for the second time is performed according to a change in the internal temperature or the like of the apparatus will be described.

A state is assumed in which in the color shift correction for the second time, a more color shift of 5 μm is created than that in the correction for the first time. In this state, the actual color shift amount is 30 μm. However, the correction for 25 μm in total is performed in the first skew correction and the second skew correction in the above color shift correction for the first time, so that a color shift amount calculated by the color shift amount calculator 411 is 5 μm [30 μm (actual color shift amount)−25 μm (25 μm corrected by the correction for the first time)=5 μm].

Then, the color shift amount to be subjected to the first skew correction is 5 μm, which is less than 10 μm that is the resolution of the first skew correction, so that the color shift amount that can be corrected by the first skew correction is not changed (increased). As a result, the value of the correction for the first time is continued, and it is determined that the color shift amount that can be corrected by the first skew correction is 20 μm.

In the second skew correction, the color shift residual of 5 μm of the first skew correction in the color shift correction for the second time is added to 5 μm that is the value of the correction for the first time. As a result, the color shift amount to be subjected to the second skew correction is 10 μm [5 μm (correction amount for the first time)+5 μm (color shift residual for the second time)=10 μm].

As described above, in the processing method according to the flowchart illustrated in FIG. 12 or FIG. 13 described above, the first skew correction controller 412 does not execute the first skew correction when the calculated color shift amount is less than the first color shift residual target value (resolution).

However, in order to minimize the margin between the images on an output object in the image forming apparatus 40, it is desirable to maximize the correction by the first skew correction by the mechanical mechanism and to minimize the execution of the image processing by the second skew correction creating a margin. Therefore, when the actual color shift amount is 30 μm in the processing for the second time in the above example, it is preferable to perform color shift correction without creating a margin due to the image processing of the second skew correction, by performing the correction for 30 μm in the first skew correction.

Figure 15:
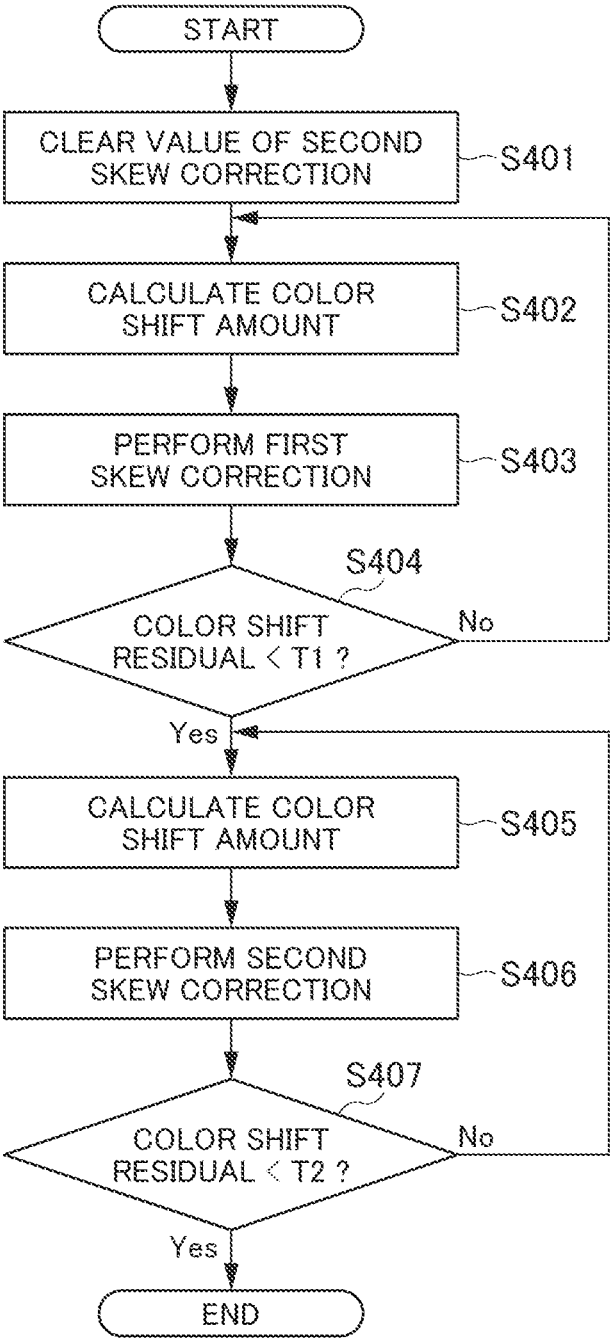
FIG. 15 is a flowchart of a fourth processing method of the skew correction.

Hereinafter, a processing method for maximizing, in the color shift correction for the second or subsequent time, the correction by the first skew correction by the mechanical mechanism will be described. FIG. 15 illustrates a flowchart of a processing method of the skew correction performed by the image forming apparatus. Note that the flowchart illustrated in FIG. 15 is processing executed subsequently after a color shift correction method is performed according to the flowchart illustrated in FIG. 12, FIG. 13, or FIG. 14 described above.

First, the second skew correction controller 413 erases (clears) the correction value of the second skew correction performed before this step (step S401).

Next, the color shift amount calculator 411 calculates a color shift amount (step S402).

The first skew correction controller 412 performs the first skew correction on the basis of the color shift amount calculated by the color shift amount calculator 411 (step S403).

After the first skew correction, the color shift amount calculator 411 calculates a color shift amount (color shift residual) after the first skew correction, and determines whether or not the color shift residual is less than the first color shift residual target value (T1) (step S404).

When the color shift residual is not less than the first color shift residual target value (T1) (No in the step S404), the controller 41 repeats the processing of the step S402 and the step S403. The first skew correction is repeated until the color shift residual after the first skew correction becomes less than the first color shift residual target value (T1).

When the color shift residual is less than the first color shift residual target value (T1) (Yes in the step S404), the color shift amount calculator 411 calculates a color shift amount after the first skew correction (step S405).

Next, the second skew correction controller 413 performs the second skew correction on the basis of the color shift amount after the first skew correction that has been calculated by the color shift amount calculator 411 (step S406).

After the second skew correction, the color shift amount calculator 411 calculates a color shift amount (color shift residual) after the second skew correction, and determines whether or not the color shift residual is less than the second color shift residual target value (T2) (step S407).

When the color shift residual is not less than the second color shift residual target value (T2) (No in the step S407), the controller 41 repeats the processing of the step S405 and the step S406. The second skew correction is repeated until the color shift residual after the second skew correction becomes less than the second color shift residual target value (T2).

When the color shift residual is less than the second color shift residual target value (T2) (Yes in the step S407), the processing according to the present flowchart is ended.

Note that the processing from the step S402 to the step S407 described above are similar to the processing from the step S101 to the step S106 illustrated in FIG. 12 described above. In addition, in the processing from the step S402 to the step S407 described above, the processing from the step S201 to the step S210 illustrated in FIG. 13 described above or the processing from the step S302 to the step S304 illustrated in FIG. 14 may be performed.

In the specific example of the above color shift correction for the second time, a case where the second color shift correction is executed along the processing of the flowchart illustrated in FIG. 15 will be described. In the image forming apparatus 40, the resolution of the first skew correction, the resolution of the second skew correction, the processing of the color shift correction for the first time, and the color shift amount for the second time are as described above. That is, a case is assumed in which in the color shift correction for the second time, a more color shift of 5 μm is created than that in the correction for the first time, and the actual color shift amount is 30 μm.

First, by clearing the correction amount of the second skew correction in the step S401, the correction amount 5 μm of the second skew correction executed in the color shift correction for the first time is set to 0 μm.

Next, the color shift amount calculator 411 calculates the color shift amount to be 10 μm in the step S402. Here, 25 μm of the total of the color shift correction for the first time (first skew correction and second skew correction) has been corrected, but the correction amount of the second skew correction has been cleared in the step S401. As a result, the calculated value by the color shift amount calculator 411 is 10 μm [30 μm (actual color shift amount)−25 μm (25 μm corrected in the correction for the first time)+5 μm (cleared second skew correction amount)=10 μm].

Next, in the step S403, the first skew correction controller 412 performs the first skew correction on 10 μm of the color shift amount that has been calculated by the color shift amount calculator 411. Here, the resolution of the first skew correction is 10 μm, so that 10 μm of the color shift amount for the second time is added to 20 μm that is the value of the correction for the first time. As a result, the color shift amount to be subjected to the first skew correction is 30 μm in total.

Next, it is determined in the step S404 that the color shift residual of 0 μm [30 μm (calculated color shift amount)−30 μm (correction value of first skew correction)=0 μm] by the first skew correction is less than the first color shift residual target value (T1).

Then, the color shift residual of the first skew correction is 0 μm, so that in the step S405, the color shift amount calculator 411 calculates a color shift amount to be subjected to the second skew correction to be 0 μm. As a result, the correction amount by the second skew correction becomes 0 in the step S406, and further becomes less than the second color shift residual target value (T2) in the step S407, and the processing according to the flowchart illustrated in FIG. 15 is ended.

In the processing according to the flowchart illustrated in FIG. 15 described above, when the actual color shift amount is 30 μm in the processing for the second time, the correction for 30 μm is performed in the first skew correction. As a result, the color shift correction can be performed without creating a margin due to the image processing of the second skew correction. Therefore, the execution of the image processing by the second skew correction creating a margin can be minimized, and the correction by the first skew correction by the mechanical mechanism can be maximized. As a result, a margin between images of the output object can be minimized

[Processing Method 5 of Color Shift Correction (Skew Correction)]

Next, a fifth processing method of color shift correction (skew correction) by the above image forming apparatus will be described. In the first processing method and the second processing method that have been described above, the first skew correction is performed after a color shift amount is calculated, but when the calculated color shift amount is less than the first color shift residual target value, it is not necessary to perform the first skew correction. Therefore, in the fifth processing method described below, the first skew correction is executed only when the color shift amount is equal to or more than the first color shift residual target value. When the color shift amount is less than the first color shift residual target value, the first skew correction is omitted, so that the time for the correction processing in the image forming apparatus 40 can be shortened.

Figure 16:
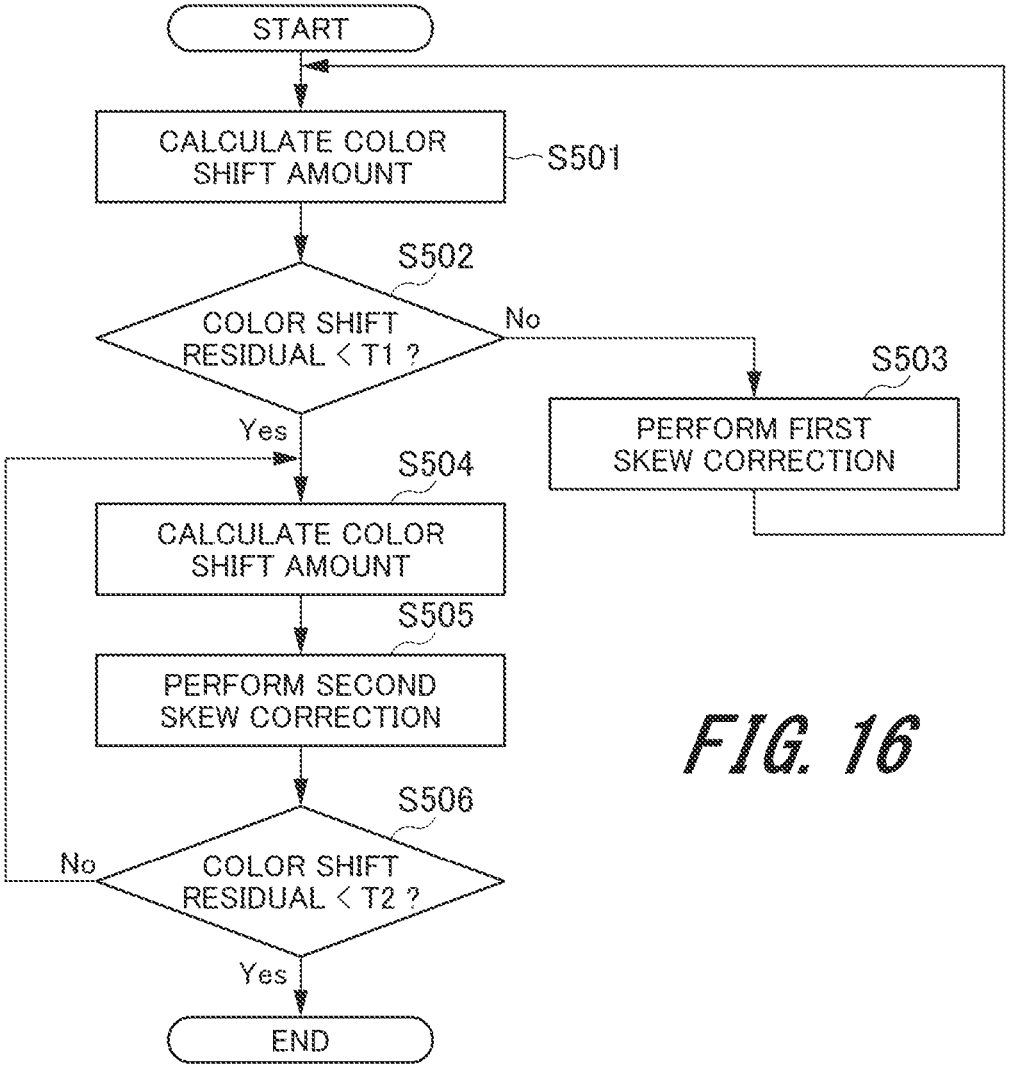
FIG. 16 is a flowchart of a fifth processing method of the skew correction.

FIG. 16 illustrates a flowchart of the fifth processing method of the skew correction performed by the image forming apparatus.

First, the image forming apparatus 40 starts image formation for testing in order to correct color shift, and the color shift amount calculator 411 calculates a color shift amount on the basis of the position of the toner image transferred to the intermediate transfer belt 465 that has been detected by the color shift detection sensor 45 (step S501).

Next, the color shift amount calculator 411 determines whether or not the calculated color shift amount is less than the first color shift residual target value (T1) (step S502).

When the color shift amount is not less than the first color shift residual target value (T1) (No in the step S502), the first skew correction controller 412 performs the first skew correction on the basis of the color shift amount calculated by the color shift amount calculator 411 (step S503). After the first skew correction, the color shift amount calculator 411 repeats the processing from the step S501 to the step S503 until the color shift amount (color shift residual) after the first skew correction becomes less than the first color shift residual target value (T1).

When the color shift amount is less than the first color shift residual target value (T1) (Yes in the step S502), the color shift amount calculator 411 calculates a color shift amount after the first skew correction (step S504).

Next, the second skew correction controller 413 performs the second skew correction on the basis of the color shift amount after the first skew correction that has been calculated by the color shift amount calculator 411 (step S505).

After the second skew correction, the color shift amount calculator 411 calculates a color shift amount (color shift residual) after the second skew correction, and determines whether or not the color shift residual is less than the second color shift residual target value (T2) (step S506).

When the color shift residual is not less than the second color shift residual target value (T2) (No in the step S506), the controller 41 repeats the processing of the step S504 and the step S505. The second skew correction is repeated until the color shift residual after the second skew correction becomes less than the second color shift residual target value (T2).

When the color shift residual is less than the second color shift residual target value (T2) (Yes in the step S506), the processing according to the present flowchart is ended.

In the processing according to the flowchart illustrated in FIG. 16 described above, the color shift amount is compared with the first color shift residual target value (T1) before the first skew correction is executed. When the color shift amount is less than the first color shift residual target value (T1), the processing of the first skew correction is omitted. As a result, the image forming apparatus 40 can perform color shift correction in a short time.

Note that, in the processing described above, processing similar to the processing from the step S101 to the step S106 illustrated in FIG. 12 described above are performed, but the processing from the step S201 to the step S210 illustrated in FIG. 13 described above or the processing from the step S302 to the step S304 illustrated in FIG. 14 may be performed.

[Processing Method 6 of Color Shift Correction (Skew Correction)]

Next, a sixth processing method of color shift correction (skew correction) by the above image forming apparatus will be described. In the first processing method and the second processing method described above, the margin amount between the images varies according to the color shift amount when the image processing is performed in the second skew correction. Therefore, in the sixth processing method described below, the second skew correction is executed such that the margin amount between images becomes a margin amount set in advance without varying.

Figure 17:
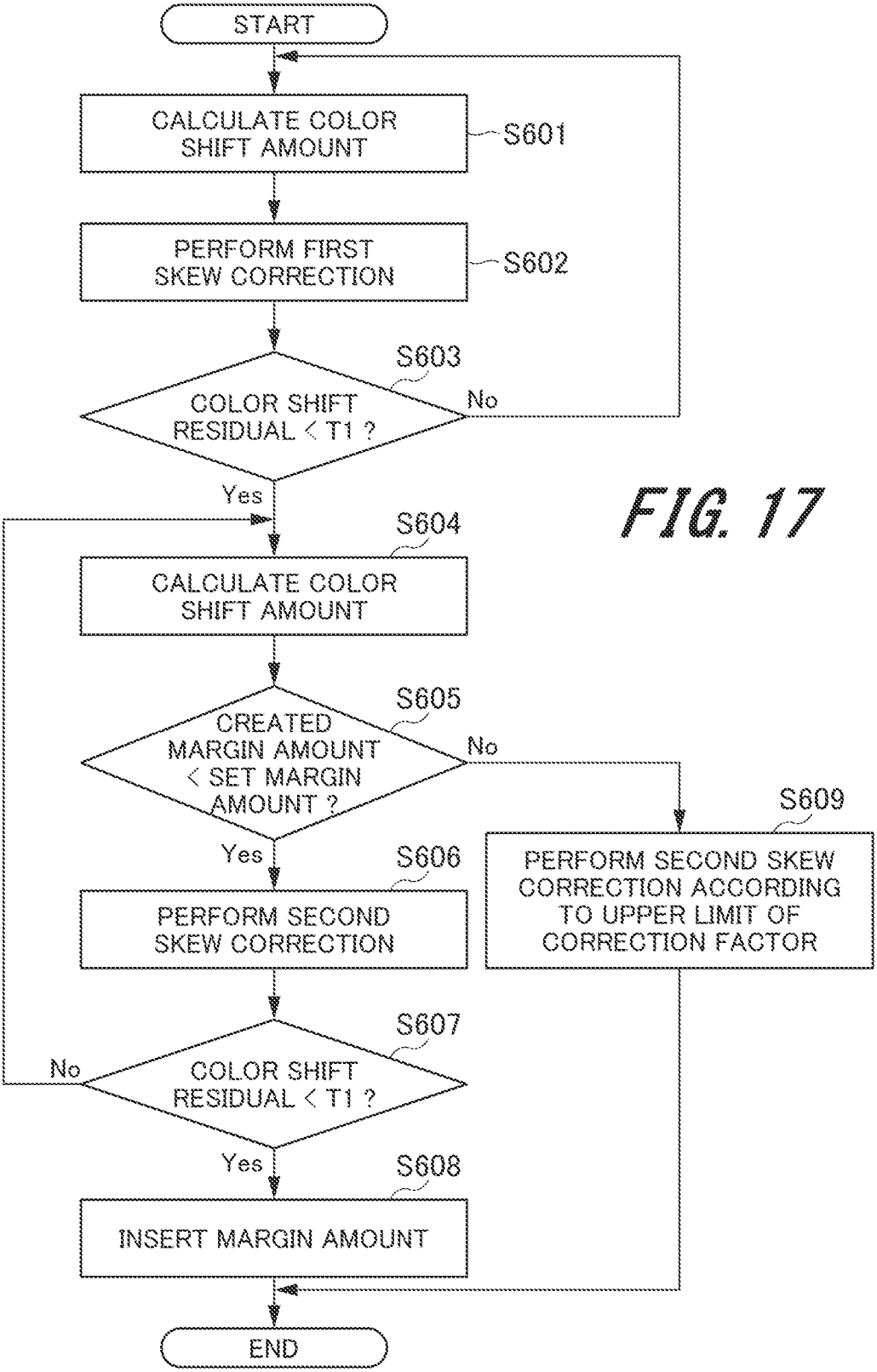
FIG. 17 is a flowchart of a sixth processing method of the skew correction.

FIG. 17 illustrates a flowchart of the sixth processing method of the skew correction performed by the image forming apparatus.

First, the image forming apparatus 40 starts image formation for testing in order to correct color shift, and the color shift amount calculator 411 calculates a color shift amount on the basis of the position of the toner image transferred to the intermediate transfer belt 465 that has been detected by the color shift detection sensor 45 (step S601).

Next, the first skew correction controller 412 performs the first skew correction on the basis of the color shift amount calculated by the color shift amount calculator 411 (step S602).

After the first skew correction, the color shift amount calculator 411 calculates a color shift amount (color shift residual) after the first skew correction, and determines whether or not the color shift residual is less than the first color shift residual target value (T1) (step S603).

When the color shift residual is not less than the first color shift residual target value (T1) (No in the step S603), the controller 41 repeats the processing of the step S601 and the step S602. The first skew correction is repeated until the color shift residual after the first skew correction becomes less than the first color shift residual target value (T1).

When the color shift residual is less than the first color shift residual target value (T1) (Yes in the step S603), the color shift amount calculator 411 calculates a color shift amount after the first skew correction (step S604).

Next, on the basis of the color shift amount after the first skew correction that has been calculated by the color shift amount calculator 411, the second skew correction controller 413 determines whether or not a margin amount to be created in the second skew correction is less than a set margin amount set by the margin setter 415 (step S605).

When the margin amount created in the second skew correction is less than the set margin amount by the margin setter 415 (Yes in the step S605), the second skew correction controller 413 performs the second skew correction on the basis of the color shift amount after the first skew correction that has been calculated by the color shift amount calculator 411 (step S606).

After the second skew correction, the color shift amount calculator 411 calculates a color shift amount (color shift residual) after the second skew correction, and determines whether or not the color shift residual is less than the second color shift residual target value (T2) (step S607).

When the color shift residual is not less than the second color shift residual target value (T2) (No in the step S607), the controller 41 repeats the processing from the step S604 to the step S606. The second skew correction is repeated until the color shift residual after the second skew correction becomes less than the second color shift residual target value (T2).

When the color shift residual is less than the second color shift residual target value (T2) (Yes in the step S607), the second skew correction controller 413 inserts a margin between the images generated by the image processing of the second skew correction so as to be the margin amount set by the margin setter 415 (step S608).

When the margin amount created in the second skew correction is not less than the set margin amount by the margin setter 415 (No in the step S605), the second skew correction controller 413 sets the set margin amount by the margin setter 415 to be an upper limit of the correction factor of the image correction of the second skew correction, and performs the second skew correction according to the upper limit of the correction factor (step S609).

After the processing of the step S608 or the step S609, the processing according to the present flowchart is ended.

Note that the processing from the step S601 to the step S603, and the step S604, the step S606, and the step S607 that have been described above are similar to the processing from the step S101 to the step S106 illustrated in FIG. 12 described above. In addition, in the processing from the step S402 to the step S407 described above, the processing from the step S201 to the step S210 illustrated in FIG. 13 described above or the processing from the step S302 to the step S304 illustrated in FIG. 14 may be performed.

In the processing according to the flowchart illustrated in FIG. 17 described above, the image processing is performed or a margin is inserted such that the set margin amount is obtained, when the second skew correction is executed. As a result, even if the color shift amount varies depending on the individual difference or internal temperature of the image forming apparatus 40, a variation in the margin amount between the images can be suppressed. Therefore, in the post-processing or the like after the image formation, it is possible to reduce the effort of changing the setting of a processing positions or a cutting position according to the margin amount between the images, so that user convenience is improved.

[Processing Method 7 of Color Shift Correction (Skew Correction)]

In the first skew correction, color shift due to the mechanical mechanism is corrected by tilting the laser writing unit 468 with the tilt adjuster 467 including a motor, a gear, and the like.

The color shift is a relative relationship between colors, and the correction is realized by defining one color as a reference and correcting the other colors. In the image former 46 of the image forming apparatus 40, however, the laser writing unit 468 is arranged for each color, and also the number of each of the motors and the gears is the same as the number of the colors. Therefore, when the color shift correction is performed, the motor or the gear may be out of order.

Therefore, in a seventh processing method described below, the first skew correction is performed such that color shift is corrected by correcting a color, for which a mechanical mechanism is not out of order, so as to match a color for which a mechanical mechanism is out of order, without performing the first skew correction on the color for which the mechanical mechanism is out of order, whereby color shift correction with more accuracy is performed. When the color shift correction is performed, black (K) is generally used as a reference color for color shift. However, for example, when a color shift residual is created even if a certain number of times of corrections are performed with black (K) as a reference, it is determined that a color other than black that creates the residual, for example, cyan (C), magenta (M), or yellow (Y) is out of order. As a result, the first skew correction is performed by changing the reference color to a color (C, M, or Y) that creates the residual.

Figure 18:
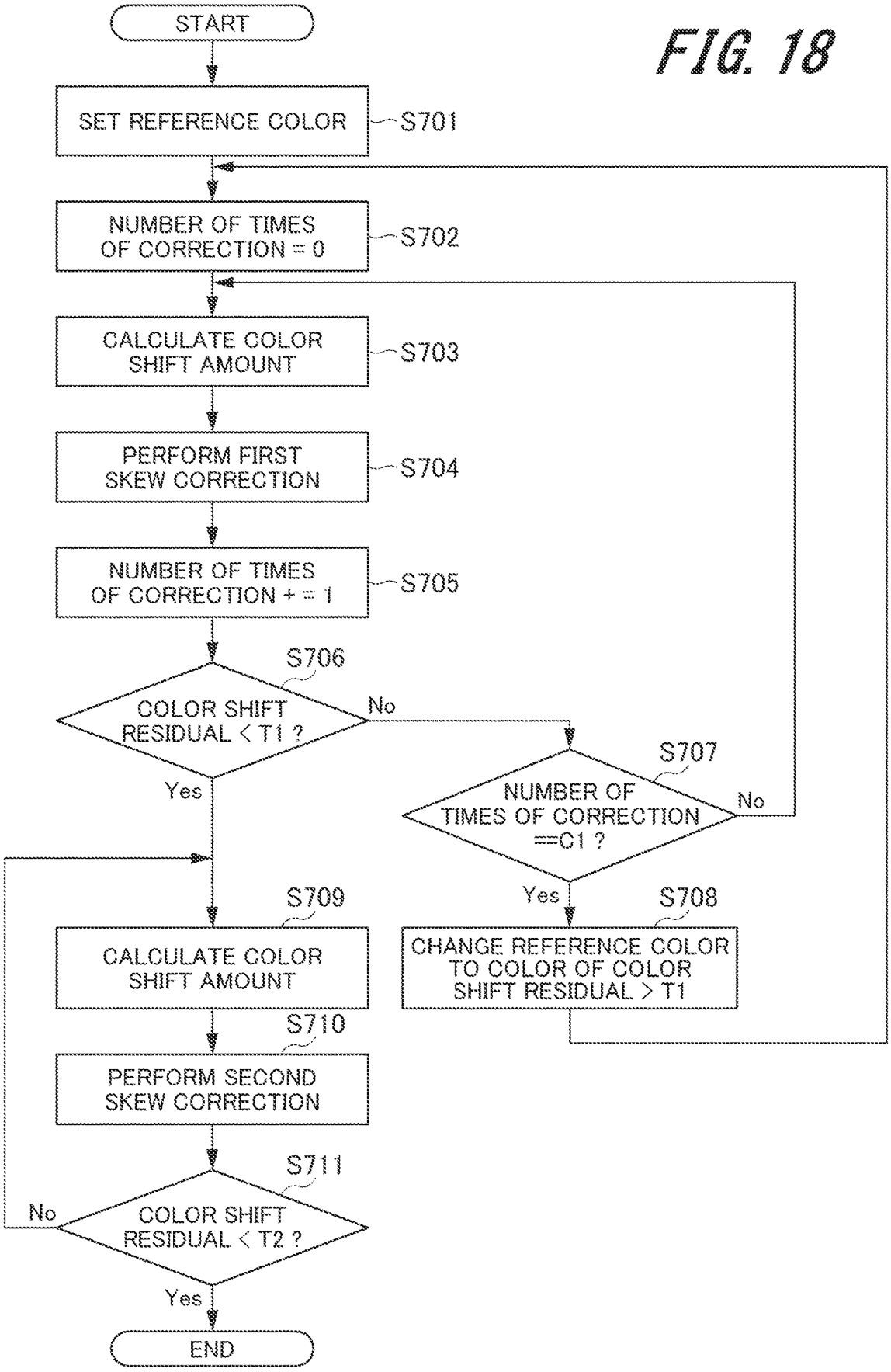
FIG. 18 is a flowchart of a seventh processing method of the skew correction.

FIG. 18 illustrates a flowchart of the seventh processing method of the skew correction performed by the image forming apparatus.

First, the first skew correction controller 412 sets a reference color that serves as a reference for color shift when the first skew correction is performed (step S701). Here, the first skew correction controller 412 sets, as an example, the reference color to black.

Next, the first skew correction controller 412 sets the count of the number of times of correction of the first skew correction, in which black is used as the reference color, to 0 (step S702).

Next, the image forming apparatus 40 starts image formation for testing in order to correct color shift, and the color shift amount calculator 411 calculates color shift amounts of, for example, toner images of cyan, magenta, and yellow other than black, on the basis of the position of the toner image of black that has been transferred to the intermediate transfer belt 465 and detected by the color shift detection sensor 45 (step S703).

Next, the first skew correction controller 412 performs the first skew correction on the laser writing units 468 for cyan, magenta, and yellow, on the basis of the color shift amounts calculated by the color shift amount calculator 411 (step S704).

Then, the first skew correction controller 412 adds 1 to the count of the current number of times of correction of the first skew correction in which black is used as the reference color (step S705).

Next, the color shift amount calculator 411 calculates, after the first skew correction, color shift amounts (color shift residuals) of the toner images of cyan, magenta, and yellow, and determines for each color whether or not the color shift residual is less than the first color shift residual target value (T1) (step S706).

When the color shift residual for any color is not less than the first color shift residual target value (T1) (No in the step S706), the first skew correction controller 412 determines whether or not the current number of times of correction, in which black is used as the reference color, matches a predetermined number of times of correction C1 set in advance (step S707). Here, the predetermined number of times of correction C1 is the number of times for determining that the mechanical mechanism for any color other than the reference color is out of order, which is a value set in advance by a user or the like.

When the current number of times of correction does not match the predetermined number of times of correction C1 set in advance (No in the step S707), the controller 41 repeats the processing from the step S703 to the step S706. The first skew correction is repeated until the color shift residual for each color after the first skew correction becomes less than the first color shift residual target value (T1).

When the current number of times of correction matches the predetermined number of times of correction C1 set in advance (Yes in the step S707), the reference color for the first skew correction is changed from the reference color (black) set in the step S701 to a color (cyan, magenta, or yellow) for which the color shift residual after the first skew correction does not become less than the first color shift residual target value (T1) (step S708). After the reference color is changed, the controller 41 repeats the processing from the step S702 to the step S706. The first skew correction is repeated until the color shift residual for each color after the first skew correction becomes less than the first color shift residual target value (T1).

When the color shift residual for each color is less than the first color shift residual target value (T1) (Yes in the step S706), the color shift amount calculator 411 calculates a color shift amount for each color after the first skew correction (step S709).

Next, the second skew correction controller 413 performs the second skew correction on the basis of the color shift amount for each color after the first skew correction that has been calculated by the color shift amount calculator 411 (step S710).

After the second skew correction, the color shift amount calculator 411 calculates a color shift amount (color shift residual) for each color after the second skew correction, and determines whether or not the color shift residual for each color is less than the second color shift residual target value (T2) (step S711).

When the color shift residual for any color is not less than the second color shift residual target value (T2) (No in the step S711), the controller 41 repeats the processing of the step S709 and the step S710. The second skew correction is repeated until the color shift residual for each color after the second skew correction becomes less than the second color shift residual target value (T2).

When the color shift residual for each color is less than the second color shift residual target value (T2) (Yes in the step S711), the processing according to the present flowchart is ended.

In the processing according to the flowchart illustrated in FIG. 18 described above, a color, for which a failure has occurred and the correction is difficult, is set, in the first skew correction, as the reference color for the correction. The color shift correction is not performed on this color, but performed on the other colors. Therefore, a time for performing the color shift correction on the color, for which a failure has occurred, can be saved, and the color shift correction can be efficiently performed. In addition, by executing the first skew correction on the basis of a color for which the mechanical mechanism is out of order, color shift correction with high accuracy can be performed.

Note that the present invention is not limited to the configurations described in the above embodiments, and various modifications and changes can be made without departing from the configurations of the present invention.

Although embodiments of the present invention have been described and illustrated in detail, the disclosed embodiments are made for purposes of illustration and example only and not limitation. The scope of the present invention should be interpreted by terms of the appended claims.

DESCRIPTION OF REFERENCE NUMERALS

1 . . . image forming system
10 . . . paper feeder
11, 61 . . . support shaft
20 . . . supply adjuster
40 . . . image forming apparatus
41 . . . controller
42 . . . operation display
43 . . . scanner
44 . . . conveyor
45 . . . detection sensor
46 . . . image former
47 . . . fixing unit
48 . . . nonvolatile memory
50 . . . recovery adjuster
60 . . . recovery apparatus
101, 102 . . . toner image
103, 104, 108, 109 . . . image data
103*a*, 103*b*, 104*a*, 104*b*, 104*c*, 104*d* . . . edge
104*e*, 104*f*, 105*a*, 105*b*, 106*a*, 106*b*, 107, 108*e*, 108*f*, 109*e*, 109*f*, 110, 110, 110*b* . . . margin
104*g*, 108*g*, 109*g* . . . image portion
105, 106 . . . image
411 . . . color shift amount calculator
412 . . . first skew correction controller
413 . . . second skew correction controller
414 . . . execution setter
415 . . . margin setter
460 . . . laser beam
461 . . . exposure unit
462 . . . photoreceptor
463 . . . developing unit
464 . . . primary transfer roller
465 . . . intermediate transfer belt

466 . . . secondary transfer roller
467 . . . tilt adjuster
468 . . . laser writing unit
469 . . . laser trajectory
471 . . . fixing roller
472 . . . pressure applying roller

The invention claimed is:

1. An image forming apparatus that forms an image of a plurality of colors on a recording material, the image forming apparatus comprising:

an image former that forms the image on the recording material; and a hardware processor that controls image formation by the image former and skew correction in the image formation, wherein:

the hardware processor includes:

a color shift amount calculator that calculates a color shift amount from a color shift of an image of each color in the image former, and a first skew correction controller and a second skew correction controller that control the skew correction of the color shift, the first skew correction controller controls a first skew correction by a mechanical operation by the image former based on a first color shift residual target value set in advance, and the second skew correction controller controls a second skew correction, by image processing, of the color shift after the control by the first skew correction controller based on a second color shift residual target value set in advance.

2. The image forming apparatus according to claim 1, wherein the hardware processor repeats the calculation of the color shift amount by the color shift amount calculator and the control of the first skew correction by the first skew correction controller until the color shift amount becomes less than the first color shift residual target value.

3. The image forming apparatus according to claim 1, wherein the hardware processor repeats the calculation of the color shift amount by the color shift amount calculator and the control of the second skew correction by the second skew correction controller until the color shift amount becomes less than the second color shift residual target value.

4. The image forming apparatus according to claim 1, wherein the first skew correction controller repeats the first skew correction a first number of times of correction set in advance.

5. The image forming apparatus according to claim 1, wherein the second skew correction controller repeats the second skew correction a second number of times of correction set in advance.

6. The image forming apparatus according to claim 1, wherein the hardware processor:

includes an execution setter that receives setting of enabling or disabling execution of the second skew correction by the second skew correction controller, executes the second skew correction by the second skew correction controller when the setting by the execution setter is enabled, and does not execute the second skew correction by the second skew correction controller when the setting by the execution setter is disabled.

7. The image forming apparatus according to claim 1, wherein the first skew correction controller executes the first skew correction when the color shift amount is equal to or more than the first color shift residual target value.

8. The image forming apparatus according to claim 1, wherein, when the skew correction is performed again after the second skew correction:

the color shift amount calculator calculates the color shift amount after the skew correction by calculating the color shift amount after the second skew correction and initializing a correction value by controlling the second skew correction, the first skew correction controller controls the first skew correction based on the color shift amount after the skew correction, and the second skew correction controller controls the second skew correction based on the color shift amount after the first skew correction.

9. The image forming apparatus according to claim 1, wherein:

the hardware processor includes a margin setter that sets a margin amount between images continually formed on the recording material to a constant value, and the second skew correction controller sets the margin amount between the images that is created by the second skew correction to the constant value set by the margin setter.

10. The image forming apparatus according to claim 9, wherein:

the margin setter receives setting of an arbitrary value by a user with respect to the constant value of the margin amount, and the second skew correction controller sets the margin amount between the images that is created by the second skew correction to the value received by the margin setter.

11. The image forming apparatus according to claim 9, wherein:

the margin setter holds a value set in advance as the margin amount, and the second skew correction controller sets the margin amount between the images that is created by the second skew correction to the value held by the margin setter.

12. The image forming apparatus according to claim 1, wherein, when the color shift amount calculator calculates the color shift amount after the first skew correction controller performs the first skew correction a predetermined number of times on a first color and when the color shift amount after the first skew correction exceeds the first color shift residual target value, the first skew correction controller performs the first skew correction on a second color.

13. The image forming apparatus according to claim 1, wherein:

the image former includes, for each color, a laser writing unit and a tilt adjuster that adjusts a tilt of the laser writing unit, and the first skew correction controller adjusts the tilt of the laser writing unit by controlling an operation amount of the tilt adjuster, and performs the first skew correction.

* * * * *